US010149358B1

(12) United States Patent
Tischler

(10) Patent No.: US 10,149,358 B1
(45) Date of Patent: Dec. 4, 2018

(54) PROGRAMMABLE CONTROL ELEMENTS FOR ILLUMINATION SYSTEMS

(71) Applicant: Michael A. Tischler, Vancouver (CA)

(72) Inventor: Michael A. Tischler, Vancouver (CA)

(73) Assignee: COOLEDGE LIGHTING INC., Richmond (CA)

( * ) Notice: Subject to any disclaimer, the term of this patent is extended or adjusted under 35 U.S.C. 154(b) by 0 days.

(21) Appl. No.: 15/457,172

(22) Filed: Mar. 13, 2017

Related U.S. Application Data

(60) Provisional application No. 62/307,793, filed on Mar. 14, 2016.

(51) Int. Cl.
*H05B 33/08* (2006.01)

(52) U.S. Cl.
CPC ..... *H05B 33/0845* (2013.01); *H05B 33/089* (2013.01); *H05B 33/0827* (2013.01)

(58) Field of Classification Search
CPC ..... H05B 33/0845; H05B 33/0815; H05B 33/089; H05B 33/0857; H05B 37/0272; H05B 33/0887; H05B 33/0812
USPC ... 315/186, 291, 185 R, 297, 152, 251, 307, 315/219
See application file for complete search history.

(56) References Cited

U.S. PATENT DOCUMENTS 9,642,209 B2 * 5/2017 Eisele ..... H05B 33/0869
2004/0256625 A1 * 12/2004 Russell ..... H05B 33/0815 257/80
2005/0231133 A1 * 10/2005 Lys ..... F21S 48/325 315/291
2008/0018261 A1 * 1/2008 Kastner ..... F21V 23/00 315/192
2008/0218099 A1 * 9/2008 Newman ..... H05B 37/0272 315/268
2010/0277104 A1 * 11/2010 Lin ..... H03K 7/08 315/312
2011/0084614 A1 * 4/2011 Eisele ..... H05B 33/0857 315/152
2011/0248648 A1 * 10/2011 Liu ..... G09G 3/3406 315/294
2013/0028338 A1 * 1/2013 Neyman ..... H03K 7/08 375/257
2013/0141010 A1 * 6/2013 Reed ..... H05B 37/02 315/294
2013/0271036 A1 * 10/2013 Maxik ..... H05B 37/02 315/307
2013/0334980 A1 * 12/2013 Zhou ..... H05B 33/0845 315/250
2017/0359879 A1 * 12/2017 Eisele ..... H05B 33/083

* cited by examiner

*Primary Examiner* — Wei Chan
(74) *Attorney, Agent, or Firm* — Morgan, Lewis & Bockius LLP

(57) ABSTRACT

In accordance with various embodiments, a programmable current control device for an illumination system receives information representative of a desired output current level, stores information representative of the desired output current level, and maintains the desired output current level for at least a portion of the illumination system.

26 Claims, 23 Drawing Sheets

FIG. 8A
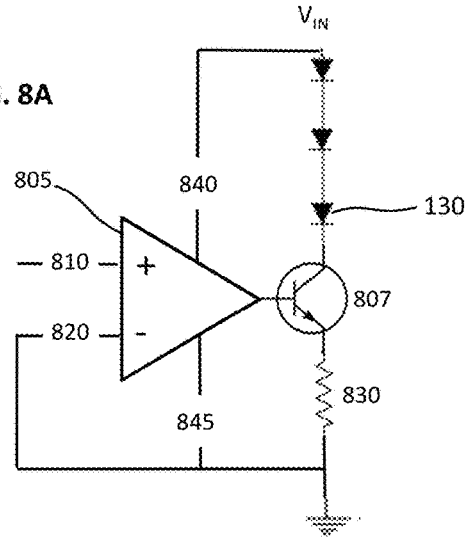
FIG. 8C
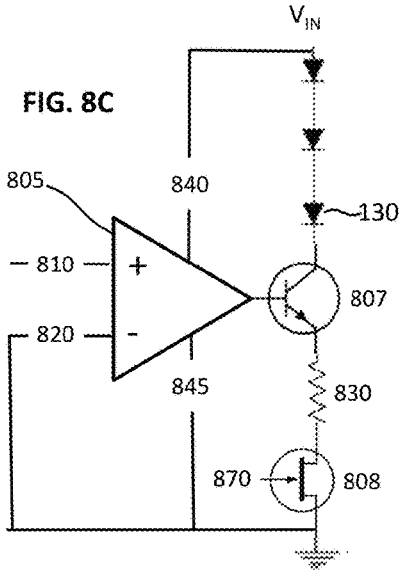
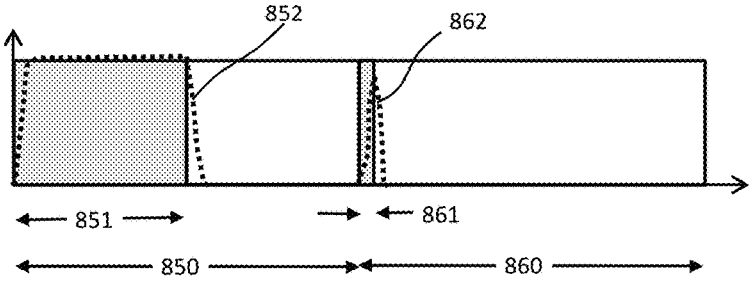
FIG. 8B
FIG. 8D
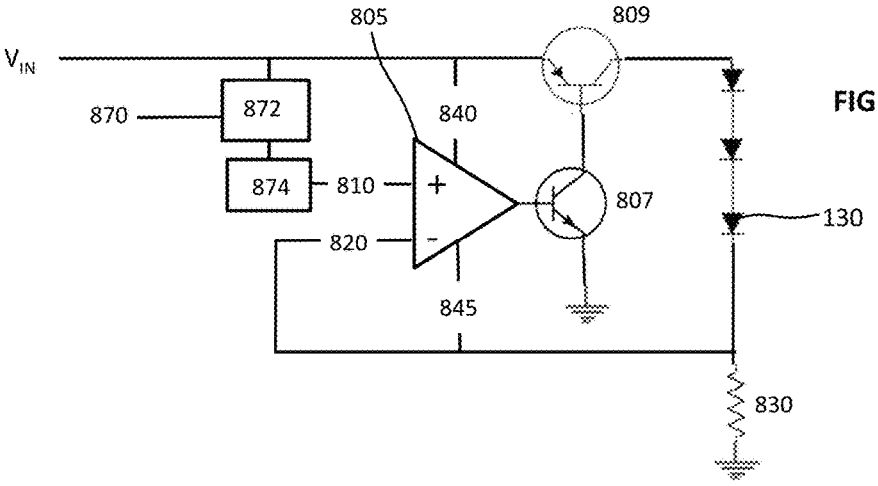

| Memory Set | Current Value |
|---|---|

FIG. 10A

| Memory Set | Current Value | Address |
|---|---|---|

FIG. 10B

| Current Value | Address |
|---|---|

FIG. 10C

| Dim Level | Address |
|---|---|

FIG. 10D

| Dim Level A | Address A | Dim Level B | Address B | Dim Level C | Address C |
|---|---|---|---|---|---|

FIG. 10E

PROGRAMMABLE CONTROL ELEMENTS FOR ILLUMINATION SYSTEMS

RELATED APPLICATIONS

This application claims the benefit of and priority to U.S. Provisional Patent Application No. 62/307,793, filed Mar. 14, 2016, the entire disclosure of which is hereby incorporated herein by reference.

FIELD OF THE INVENTION

In various embodiments, the present invention generally relates to electronic devices, and more specifically to array-based electronic devices.

BACKGROUND

Light sources such as light-emitting diodes (LEDs) are an attractive alternative to incandescent and fluorescent light bulbs in illumination devices due to their higher efficiency, smaller form factor, longer lifetime, and enhanced mechanical robustness. One advantage of LEDs is that it is relatively easy to vary the light output intensity over a wide range, thus meeting the needs of a wide range of customers and/or applications using one or a relatively few number of LED components.

LEDs are inherently current-controlled devices, with the light output intensity varying with the applied current although in many applications a constant or variable voltage supply is used to power LEDs. In such scenarios, it is common to provide current regulation or current-limiting means to ensure that the LEDs operate at a desired and relatively constant current (and thus at a desired and relatively constant light intensity) and are not subject to over-current conditions which may damage the LEDs.

Various means for controlling or regulating the current have been employed. One simple approach is to use a resistor in series with an LED, as shown in FIG. 1A. The circuit of FIG. 1A includes power bus providing a constant voltage to power conductors 110 and 120. LEDs 130 are electrically coupled in series with current-limiting resistor 160 between power conductors 120 and 110. As is well known in the field, the disadvantage of this approach is while it does provide a measure of current-limiting functionality, the current through the LED varies proportionally with the applied voltage in accordance with Ohm's law.

Many different active circuits have been utilized to provide a relatively constant current over a relatively wide range of applied voltages. Various examples of such circuits or current control elements (CEs) are described in U.S. patent application Ser. No. 13/799,807, filed on Mar. 13, 2013 ("the '807 application"), and U.S. patent application Ser. No. 13/970,027, filed on Aug. 19, 2013 ("the '027 application"), the entire disclosure of each of which is incorporated by reference herein. FIG. 1B shows an example of one such CE 140, which includes or consists essentially of two NPN bipolar junction transistors (BJTs) 170, 171 and two resistors 180, 181, is electrically coupled in series with the string of LEDs 130, and may be located at one end of the string or anywhere mid-string. The value of resistor 181 determines the current between the two terminals of CE 140 identified in FIG. 1B as 190 and 191. Such a CE 140 acts like a two-terminal polarized device, allowing current to flow only in one direction and maintaining an essentially constant current, as determined by the value of resistor 181. Similar circuits using FETs may also be utilized, as described in the '807 and '027 applications. Versions of such circuits, as well as those incorporating additional features such as temperature compensation, are commercially available in single packages, for example the AL5802 manufactured by Diodes, Inc. In various versions, the current set resistor (e.g., resistor 181) may be internal or external to the package.

A disadvantage of these approaches is that the current is fixed, e.g., determined by a fixed resistance value of a current-set resistor, for example resistor 181 in the circuit of FIG. 1B. If the current set resistor is internal to the current control circuit package, then multiple packages are required to achieve different intensity values, with each package set to a different current. If the current set resistor is external to the package, a different resistor for each desired intensity level from the LEDs is required. In either case there is a requirement to stock a large number of parts (either current control packages or resistors) of different values in order to achieve a wide range of light output intensities from the LED illumination source. Furthermore, if finished goods are desired to be inventoried, for example to reduce lead time, then the number of different products required to be inventoried increases with the number of required light intensity values for each product, resulting in increased costs. In some cases, the required current value may not be known prior to the design of the lighting system, thus precluding manufacture of the complete system until the desired current level is determined, resulting in long delivery lead times and loss of economies of scale in producing large volumes of lighting systems in batch form.

In view of the foregoing, a need exists for systems and techniques enabling the low-cost, rapid design and manufacture of LED lighting systems having a wide range of light output intensities.

SUMMARY

In accordance with certain embodiments, lighting systems include programmable current control elements that enable temporary or permanent programming of the value of the current to be controlled or regulated, for one or more light-emitting elements and/or illumination systems, without the need for external components such as current set resistors.

Additional details of lighting systems in accordance with embodiments of the present invention appear within U.S. patent application Ser. No. 13/799,807, filed Mar. 13, 2013 (the '807 application), U.S. patent application Ser. No. 13/748,864, filed Jan. 24, 2013 (the '864 application), and U.S. patent application Ser. No. 14/699,149, filed Apr. 29, 2015 (the '149 application), the entire disclosure of each of which is incorporated by reference herein.

In an aspect, embodiments of the invention feature a programmable current control device for an illumination system. The device includes, consists essentially of, or consists of first, second, and third connection points, a memory element, and control circuitry. The first connection point receives information representative of a desired output current level. The memory element stores the information representative of the desired output current level received at the first connection point. The memory element may be nonvolatile, whereby the memory element retains the information without application of power to the memory element. The second and third connection points electronically connect to at least a portion of the illumination device. The control circuitry maintains a substantially constant current, at approximately the desired output current level, between the second and third connection points.

Embodiments of the invention may include one or more of the following in any of a variety of combinations. The memory element may be one-time programmable. The memory element may be programmable two or more times. The memory element may include, consist essentially of, or consist of a fusible link, an antifuse, an EPROM, an EEPROM, NOR Flash, NAND flash, nvSRAM, FeRAM, MRAM, and/or PCM. The first connection point may be configured to receive signals to store the information representative of the desired output current level in the memory element. The programmable current control device may be configured to receive signals, at the first connection point, to store the information representative of the desired output current level in the memory element. The programmable current control device may be configured with an identifier. The first connection point may be configured to receive identifier information. The programmable current control device may be configured to receive identifier information at the first connection point. The memory element may be configured for storage of the information representative of the desired output current level received at the first connection point only if the identifier information received at the first connection point matches the identifier of the programmable current control device. The identifier for the programmable current control device may be a unique identifier (e.g., an identifier different from identifiers assigned to other programmable current control devices, within the illumination system or not). The illumination system may include one or more additional programmable current control devices each configured with an identifier. The identifier of the programmable current control device may be different from the identifiers of the additional programmable current control devices.

The programmable current control device may include a communication element for receiving the information representative of the desired output current level from the first connection point and supplying the information representative of the desired output current level to the memory element. The communication element may utilize a communication protocol (e.g., a one-wire communication protocol) to receive identifier information and information representative of the desired output current at the first connection point. The communication element may supports serial protocol, parallel protocol, and/or up/down protocol. The communication element may utilize a one-wire communication protocol to receive information representative of a desired output current level at the first connection point. The memory element may include, consist essentially of, or consist of a potentiometer (e.g., a digital potentiometer). The programmable current control device may include a modulation element configured to receive a modulation signal and modify the substantially constant current in response to the modulation signal. The first connection point may be configured to receive information representative of a dimming level. The programmable current control device may be configured to receive, at the first connection point, information representative of a dimming level. The control circuitry may be configured to adjust the substantially constant current to a value represented by the dimming level. The programmable current control device may be configured with an identifier. The first connection point may be configured to receive information representative of a dimming level. The programmable current control device may be configured to receive, at the first connection point, information representative of a dimming level. The first connection point may be configured to receive identifier information. The programmable current control device may be configured to receive identifier identification at the first connection point. The control circuitry may be configured to adjust the substantially constant current to a value represented by the dimming level if (e.g., only if) the identifier information received at the first connection point matches the identifier of the programmable current control device.

In another aspect, embodiments of the invention feature an illumination system that includes, consists essentially of, or consists of first and second power conductors, a plurality of light-emitting strings, and one or more programmable current control devices each configured to supply a substantially constant desired output current level to one or more of the light-emitting strings. Each light-emitting string has a first end electrically coupled to the first power conductor and a second end electrically coupled to the second power conductor. The power conductors supply power to the light-emitting strings. Each programmable current control device includes, consists essentially of, or consists of a first connection point for receiving information representative of the desired output current level, a memory element for storing the information representative of the desired output current level received at the first connection point, second and third connection points electronically coupled to the one or more light-emitting strings, and control circuitry for maintaining a substantially constant current, at approximately the desired output current level, between the second and third connection points. The memory element may be nonvolatile, whereby the memory element retains the information without application of power to the memory element.

Embodiments of the invention may include one or more of the following in any of a variety of combinations. The one or more programmable current control devices may include, consist essentially of, or consist of a plurality of programmable current control devices. Each programmable current control device may be coupled to a different light-emitting string. Each light-emitting string may be coupled to a different programmable current control device. The first connection points of all of the programmable current control devices may be electrically coupled together. The first connection points of one or more of the programmable current control devices may be coupled together but separately from the first connection points of one or more others of the programmable current control devices. The memory element may be one-time programmable. The memory element may be programmable two or more times.

Each programmable current control device may be configured with an identifier. The first connection point may be configured to receive identifier information. Each programmable current control device may be configured to receive identifier information at the first connection point. The memory element may be configured for storage of the information representative of the desired output current level received at the first connection point only if the identifier information received at the first connection point matches the identifier of the programmable current control device. One or more (or even each) programmable current control device may include a communication element for receiving the information representative of the desired output current level from the first connection point and supplying the information representative of the desired output current level to the memory element. The communication element may utilize a communication protocol (e.g., a one-wire communication protocol) to receive identifier information and information representative of the desired output current at the first connection point. The first connection point may be configured to receive information representative of a dimming level. Each programmable current control device may be configured to receive, at the first connection point, information representative of a dimming level. The control circuitry may be configured to adjust the substantially constant current to a value represented by the dimming level. Each programmable current control device may be configured with an identifier. The first connection point may be configured to receive information representative of a dimming level. Each programmable current control device may be configured to receive, at the first connection point, information representative of a dimming level. The first connection point may be configured to receive identifier information. Each programmable current control device may be configured to receive identifier identification at the first connection point. The control circuitry may be configured to adjust the substantially constant current to a value represented by the dimming level if (e.g., only if) the identifier information received at the first connection point matches the identifier of the programmable current control device.

These and other objects, along with advantages and features of the invention, will become more apparent through reference to the following description, the accompanying drawings, and the claims. Furthermore, it is to be understood that the features of the various embodiments described herein are not mutually exclusive and can exist in various combinations and permutations. Reference throughout this specification to "one example," "an example," "one embodiment," or "an embodiment" means that a particular feature, structure, or characteristic described in connection with the example is included in at least one example of the present technology. Thus, the occurrences of the phrases "in one example," "in an example," "one embodiment," or "an embodiment" in various places throughout this specification are not necessarily all referring to the same example. Furthermore, the particular features, structures, routines, steps, or characteristics may be combined in any suitable manner in one or more examples of the technology. As used herein, the terms "about," "approximately," and "substantially" mean±10%, and in some embodiments, ±5%. The term "consists essentially of" means excluding other materials that contribute to function, unless otherwise defined herein. Nonetheless, such other materials may be present, collectively or individually, in trace amounts.

Herein, two components such as light-emitting elements and/or optical elements being "aligned" or "associated" with each other may refer to such components being mechanically and/or optically aligned. By "mechanically aligned" is meant coaxial or situated along a parallel axis. By "optically aligned" is meant that at least some light (or other electromagnetic signal) emitted by or passing through one component passes through and/or is emitted by the other. As used herein, the terms "phosphor," "wavelength-conversion material," and "light-conversion material" refer to any material that shifts the wavelength of light striking it and/or that is luminescent, fluorescent, and/or phosphorescent.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which:

FIG. 8A is a schematic illustration of a current control element in accordance with various embodiments of the invention;

FIG. 8B is a schematic timing diagram for dimming in accordance with various embodiments of the invention;

FIGS. 8C-8E are schematic illustrations of current control elements in accordance with various embodiments of the invention;

FIGS. 10A-10E are schematic illustrations of communication signals in accordance with various embodiments of the invention.

DETAILED DESCRIPTION

Figure 2A:
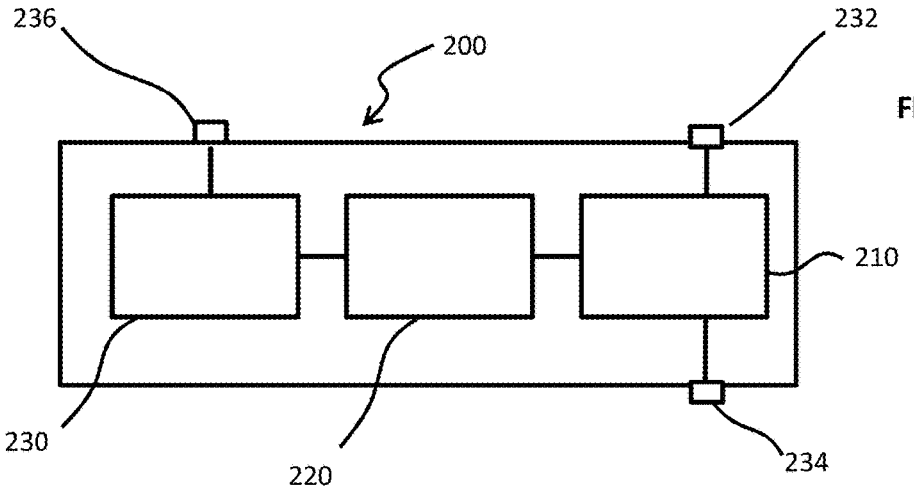
FIG. 2A is a schematic diagram of a programmable control element in accordance with various embodiments of the invention.

FIG. 2A is a schematic drawing of a programmable current control element (PCE) 200 for use with illumination systems and other electronic systems in accordance with embodiments of the present invention. PCE 200 enables temporary or permanent programming of the value of the current to be controlled or regulated without the need for a multiplicity of different values of an external component such as a current set resistor. PCE 200 includes, consists essentially of, or consists of one or more elements, for example a current control element (CE) 210, a memory element (ME) 220, and a communication element (COMME) 230 as shown in FIG. 2A. As will be discussed herein, a signal representative of a desired current value may be communicated from an external system (not shown in FIG. 2A) through connection point 236 to COMME 230. The desired current value or a value representative of the current value is stored in ME 220 and used by CE 210 to regulate or control the current through connection points 232 and 234 at the desired value or at substantially the desired value. In various embodiments of the invention, ME 220 (and thus PCE 200) provides non-volatile memory capability, thus retaining information even when disconnected from a power source. This permits retention of the programmed current value if power is removed from PCE 200. In other words, in various embodiments a lighting system including one or more PCEs 200 may be power cycled without losing the desired current value(s).

In various embodiments of the present invention the current level may be set by the value of a current set resistor incorporated into PCE 200, as described herein. For example, in FIG. 1B the resistor 181 acts as the current set resistor. The transistor 170 acts as a buffer that is turned on by base current flowing through resistor 180—changes in string voltage are thus taken up by transistor 170. Once current starts flowing through transistor 170, base current is provided to turn on transistor 171. With transistor 171 turned on, the voltage across the base-emitter junction of transistor 171 is nominally, e.g., 0.6V, which is the typical voltage drop of a standard forward-biased silicon diode p-n junction. This base emitter voltage acts as a reference, so dividing that voltage by the value of resistor 181 defines the current set point of the circuit. It is self-correcting in the following manner. If more current tries to flow through transistor 170, the voltage at the base of transistor 171 will rise along with the base current into transistor 171, which will increase the amount of current which may flow through transistor 171. This in effect "steals" base current away from transistor 170, which in turn will reduce the amount of current which may pass through transistor 170. This negative feedback self-regulates the amount of current that may flow through the circuit. Resistor 180 preferably has a resistance value sufficiently high to limit the amount of bias current that may flow through transistor 171 to less than approximately 5% of the current through resistor 180. Thus, the total current through the LED string will be nominally, in this example, the bias current added to 0.6V divided by this resistance value. Finally, as the voltage across the circuit changes, for example if one or more LEEs in the string short out, the voltage across transistor 170 and resistor 180 will increase, which will slightly increase the base current into transistor 170, thus allowing more current to flow through transistor 170. Thus, even with the feedback response of transistor 171 the drive current may increase slightly. For example, if the voltage across transistor 170 changes by about 10 V, the current through the circuit will increase by less than about 1 mA. The description above is of a current control circuit of a specific embodiment of this invention, and in other embodiments the circuit layout, elements, and configuration for the circuitry for setting and controlling the current may be different; the specific circuit is not a limitation of the present invention, for example in various embodiments of the present invention the current may be set by an analog voltage representative of the desired current value, a digital representation of the desired current value, or any other representation.

In various embodiments, PCE 200 may have one or more connection points, for example to electrically couple PCE 200 to light-emitting elements (LEEs) such as LEDs or lasers, a source of power or other components, or to temporarily or permanently communicate and/or send programming or control signals to COMME 230. FIG. 2A shows PCE 200 configured with three connection points 232, 234, and 236; however, this is not a limitation of the present invention, and in other embodiments fewer or more connection points may be utilized. In various embodiments of the present invention, one or more connection points (not shown in FIG. 2A) may be utilized to provide power to one or more elements of PCE 200; however, this is not a limitation of the present invention, and in other embodiments power may be supplied as part of the connection to other elements, for example as part of the connection between connection points 232 and 234.

In various embodiments of the present invention, PCE 200 is configured as a unitary package; however, this is not a limitation of the present invention, and in other embodiments the elements of PCE 200 may be provided in two or more separate portions or packages.

In various embodiments of the present invention, communication, for example programming signals, may be provided to COMME 230 through connection point 236 using a one-wire control or communication protocol, in which case PCE 200 may require only one wire or connection point for programming and/or communication. However, this is not a limitation of the present invention, and in other embodiments connection point 236 may represent more than one wire, conductor or connection point and communication to or programming of PCE 200 may utilize more than one wire. In various embodiments of the invention, COMME 230 and/or other communication elements described herein may include, consist essentially of, or consist of signal transmission and/or signal receiving circuitry for the receipt of signals via connection point 236 and transmission of such signals (and/or other signals based on such signals) to one or more other portions of the PCE (e.g., to the memory element and/or the control element). In various embodiments COMME 230 may include, consist essentially of, or consist of one or more modules that support a communication protocol, for example 1-Wire, Up/Down, $I^2C$, SPI, Serial, Parallel, Ethernet, Bluetooth, WiFi, or the like. (These communication protocols may be synchronous, asynchronous, single master or multi master, half duplex, full duplex, peer, multi-drop, or multi-point.) In various embodiments, COMME 230 may include, consist essentially of, or consist of hardware (for example electronic circuitry) and/or software. In various embodiments of the present invention, the function of COMME 230 is to translate an external communication signal to usable information for use by PCE 200; thus, in various embodiments COMME 230 may include, consist essentially of, or consist of analog and/or digital circuitry, a microcontroller, microprocessor, look-up table, or other circuitry to translate the external communication signal to a commands or information within PCE 200, for example to provide a desired current value, to provide a specific address of a PCE 200, to set or fix the desired current value in non-volatile memory, to provide a desired dimming level or the like. The specific type or circuitry of COMME 200 is not a limitation of the present invention.

Figure 2B:
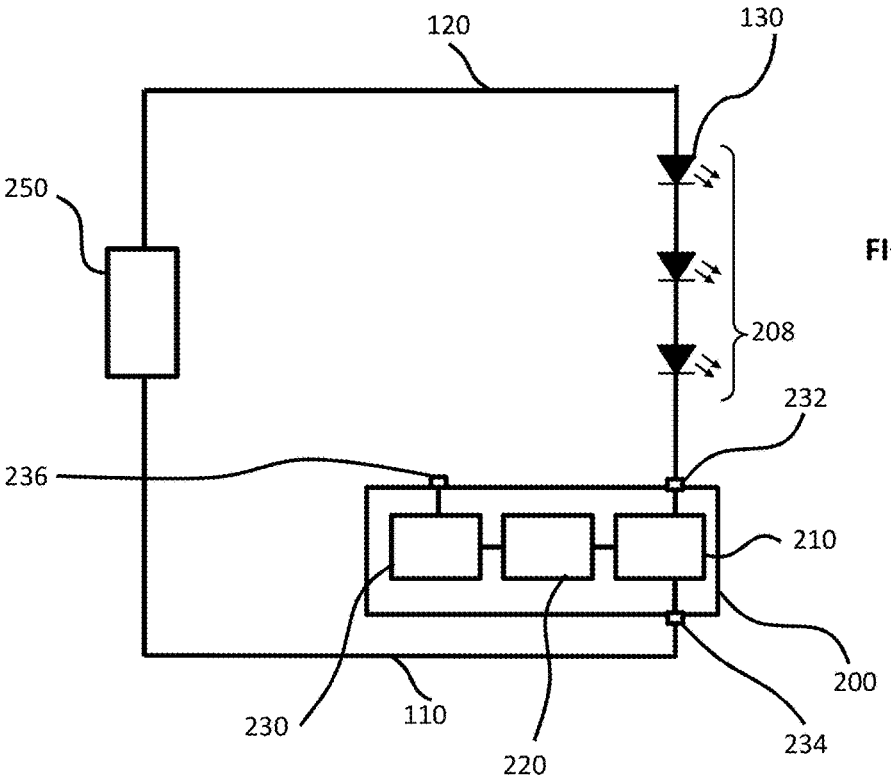
FIGS. 2B-2D are schematic illustrations of electrical configurations of lighting systems in accordance with various embodiments of the invention.

In various embodiments of the present invention, PCE 200 may be electrically coupled to one or more LEEs through connection points 232 and 234, for example as shown in FIG. 2B. While FIG. 2B shows PCE 200 electrically coupled between the end of string 208 of LEEs 130 and power conductor 110, this is not a limitation of the present invention, and in other embodiments PCE 200 may be electrically coupled between LEEs 130 within string 208 or between the opposite end of string 208 and power conductor 120. While FIG. 2B shows PCE 200 electrically coupled to a series-connected string of LEEs 130 in string 208, this is not a limitation of the present invention, and in other embodiments PCE 200 may be electrically coupled to one LEE 130 or to multiple LEEs 130 that may be electrically coupled or configured in any way, for example in parallel, series/parallel or any arbitrary configuration. Note that while FIG. 2B shows string 208 including or consisting essentially of one or more LEEs 130, in various embodiments string 208 may include other elements as well, for example one or more PCEs 200. In various embodiments of the present invention, the programmable current range and granularity may be different and may be determined by the requirements of the lighting system. In various embodiments, the current may be programmed in steps, for example in steps of about 25 mA, about 5 mA, about 1 mA or about 0.5 mA; however, these step levels are not a limitation of the present invention, and in other embodiments different current step levels may be utilized or the current may be programmed in a continuous fashion or the steps may not be equal over the entire current range. For example, in various embodiments the current steps may be relatively smaller at the low end of the current scale and relatively larger at the high end of the current scale. In various embodiments, the current step may be about 0.1% to about 2% of the full scale current value at the lower end of the current scale, for example below about 50% of full scale or below about 25% of full scale, and about 1% to about 5% of the full scale current value at the higher end of the current scale, for example above about 50% of the full scale or above about 75% of the full scale. In various embodiments, the current steps may scale in a logarithmic fashion or in any other fashion. In various embodiments of the present invention, the programmable current levels may span a range of a factor of about 50, for example from about 1 mA to about 50 mA; however, this is not a limitation of the present invention, and in other embodiments the programmable current levels may span a range of a factor of about 10, or a factor of about 25, or a factor of about 100, or any other factor. In various embodiments of the present invention, the repeatability of the programmed current level may be about ±5%, or ±2%, or ±1%, or ±0.5%; however, this is not a limitation of the present invention, and in other embodiments the programming repeatability may have other values. In various embodiments of the present invention, the accuracy of the programmed current level may be about ±5%, or ±2%, or ±1%, or ±0.5%; however, this is not a limitation of the present invention, and in other embodiments the programming repeatability may have other values.

In various embodiments, the light intensity or light output power of the lighting system may be adjustable or may be dimmed. In various embodiments, the light output power of the lighting system may be adjusted by modulating the output power from a power supply 250. In various embodiments, the light intensity of the lighting system may be adjusted by pulse width modulating the output power from power supply 250. In various embodiments, the light intensity of the lighting system may be adjusted by a signal to COMME 230, for example through connection point 236 or another connection point. In various embodiments of the present invention, the dimming capability may be to about 1% of full scale, to about 0.1% of full scale, to about 0.05% of full scale or below.

In various embodiments of the present invention, the programmed current value (or a representation of the programmed current value) may be stored in ME 220 such that the programming or control signal coupled to connection point 236 may be removed while still maintaining regulation of the desired current value through connection points 232 and 234. In various embodiments of the present invention, all or one or more portions of ME 220 may include or consist essentially of a volatile memory element, such as random access memory (RAM) or static RAM (SRAM) that maintains the values in memory as long as power is maintained to PCE 200. In various embodiments of the present invention, all or one or more portions of ME 220 may include or consist essentially of a non-volatile memory element that permits temporary (i.e., until rewritten or overwritten) or permanent storage of the programmed current value (or a representation of the programmed current value) even when no power is supplied to PCE 200, for example such that the system may be power cycled while maintaining the same current regulation value. In various embodiments of the present invention, the non-volatile memory, for example EEPROM or the like, may permit re-programming. In various embodiments of the present invention, the non-volatile memory may be a one-time programmable (OTP) memory that may only be programmed one time and may not be re-programmed a second or subsequent time. In various embodiments of the present invention, the non-volatile memory may be a programmable memory that may only be programmed a fixed number of times or that may be programmed without a limit on the number of times it may be programmed. For clarity, references herein to a memory element include memory elements of any size or capacity. As discussed herein, in various embodiments of the invention, PCE 200 has the ability to retain the desired current value without power being applied to PCE 200; in various embodiments the non-volatile retention function may be incorporated in ME 220; however, this is not a limitation of the present invention, and in various embodiments the non-volatile retention function may be incorporated in other elements of PCE 200, as discussed herein.

Figure 2C:
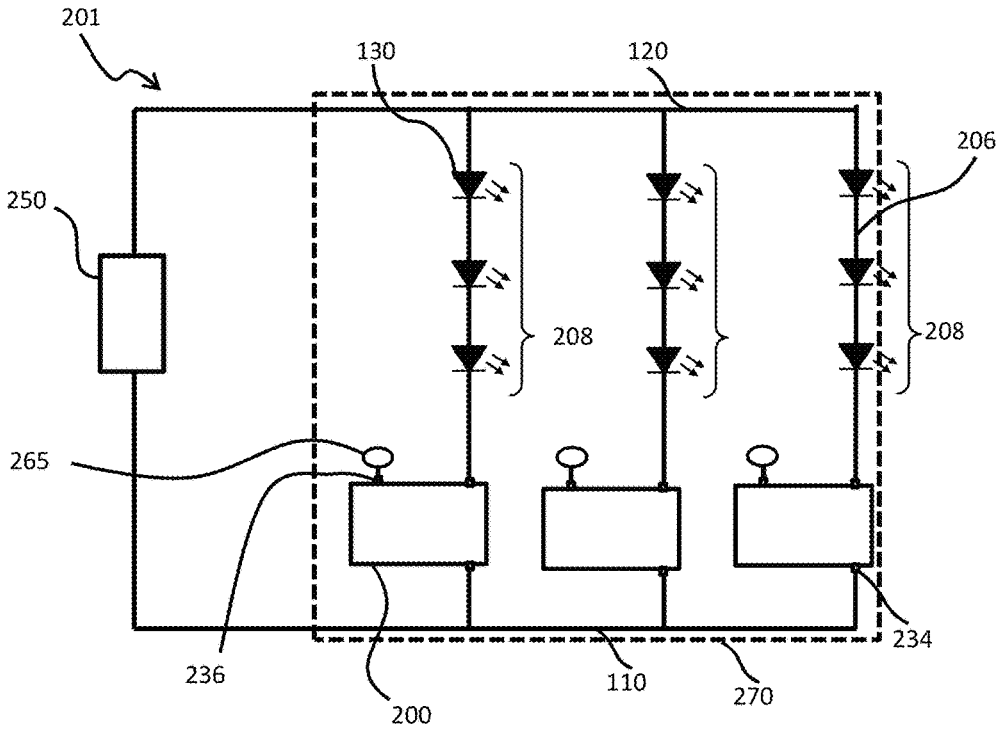

FIG. 2C shows a lighting system 201 in accordance with various embodiments of the present invention. Lighting system 201 includes or consists essentially of a lighting unit 270 and power supply 250 electrically coupled to and providing power to lighting unit 270. Lighting unit 270 includes or consists essentially of multiple strings 208 of series-connected LEEs 130, each string 208 electrically coupled to a PCE 200, where PCE 200 regulates the current in the string 208 of LEEs 130 coupled to the PCE 200. In various embodiments, LEEs 130 and PCEs 200 may be electrically coupled by conductive elements 206 (e.g., conductive traces). Each string 208 is electrically coupled to power conductors 110, 120, which are electrically coupled to power supply 250. In various embodiments, lighting system 201 may include a fixture or lighting unit 270 that includes or consists essentially of LEEs 130 and PCEs 200 and associated electrical conductors, for example power conductors 110 and 120 and conductive traces 206, with power supply 250 physically separate from light unit 270; however, this is not a limitation of the present invention, and in other embodiments lighting system 201 may be a single unitary structure that includes power supply 250 and lighting unit 270. While FIG. 2C shows string 208 of LEEs 130 including three LEEs 130, this is not a limitation of the present invention and in other embodiments fewer or more LEEs 130 may be included in string 208. While FIG. 2C shows string 208 including or consisting essentially of series-connected LEEs 130, this is not a limitation of the present invention, and in other embodiments LEEs 130 may be electrically coupled in other configurations, for example in parallel, in series/parallel, or in any combination. While FIG. 2C shows one PCE 200 electrically coupled to each string 208, this is not a limitation of the present invention, and in other embodiments multiple strings 208 may be electrically coupled to one PCE 208.

In various embodiments of the present invention, power supply 250 may include or consist essentially of a constant or substantially constant voltage supply. For example, in various embodiments of the present invention, power supply 250 may provide power at a constant or substantially constant voltage having a value of about 100V or about 58V or about 48 V or about 24V; however, the actual value of the voltage is not a limitation of the present invention. In various embodiments of the present invention, the voltage may be limited to less than 60 V, for example for use with a UL Class 2 rated system.

In system 201 of FIG. 2C, connection point 236 for programming PCE 200 may be electrically coupled to a test pad 265 or other electrically accessible structure or feature. In various embodiments test pad 265 may be positioned on a portion of lighting system 270 to provide access to PCE 200, for example during or after manufacture. For example, in various embodiments lighting system 270 may include or consist essentially of a printed circuit board, and test pad 265 may be disposed on the printed circuit board to provide convenient access to PCE 200. In various embodiments, connection point 236 may be electrically coupled to a control system for direct programming. In various embodiments of the present invention, PCE 200 may be programmed during manufacture and/or use (i.e., after fabrication and/or installation) through test pad 265. In the example shown in FIG. 2C, each PCE 200 may be separately programmed, for example to have the same or different current values.

Figure 2D:
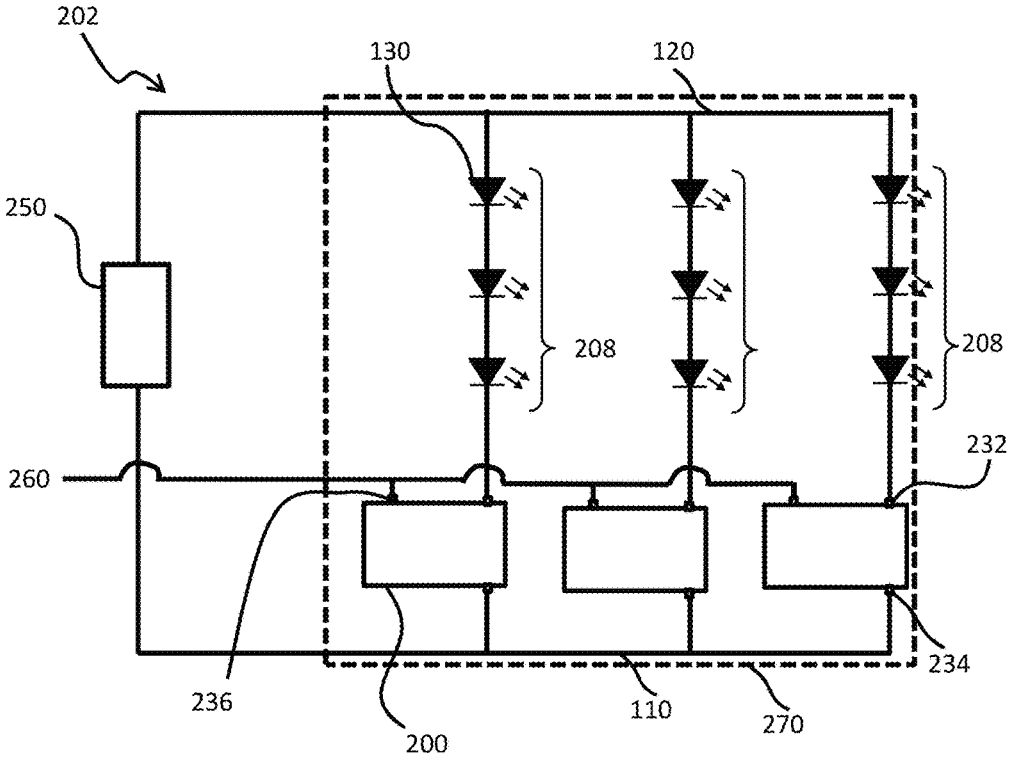

FIG. 2D shows a system 202 that is similar to system 201 of FIG. 2C; however, in system 202 multiple connection points 236 for programming PCEs 200 are electrically coupled together such that multiple PCEs 200 may be programmed together, for example with programming signal 260 input to a common connection point (e.g., a conductive pad or contact or electrical connection to a control or programming system). In various embodiments, programming signal 260 may be introduced through a test pad, for example similar to test pad 265 of FIG. 2C; however, this is not a limitation of the present invention, and in other embodiments programming signal 260 may be sourced or generated from an integral or separate control unit, a separate building control system of the like. The source of programming signal 260 is not a limitation of the present invention.

In various embodiments of the present invention, lighting unit 270 may include or consist essentially of LEEs 130 mounted on a rigid or flexible substrate or printed circuit board; however, this is not a limitation of the present invention, and in other embodiments LEEs may be disposed on other parts of the lighting unit 270.

Figure 3A:
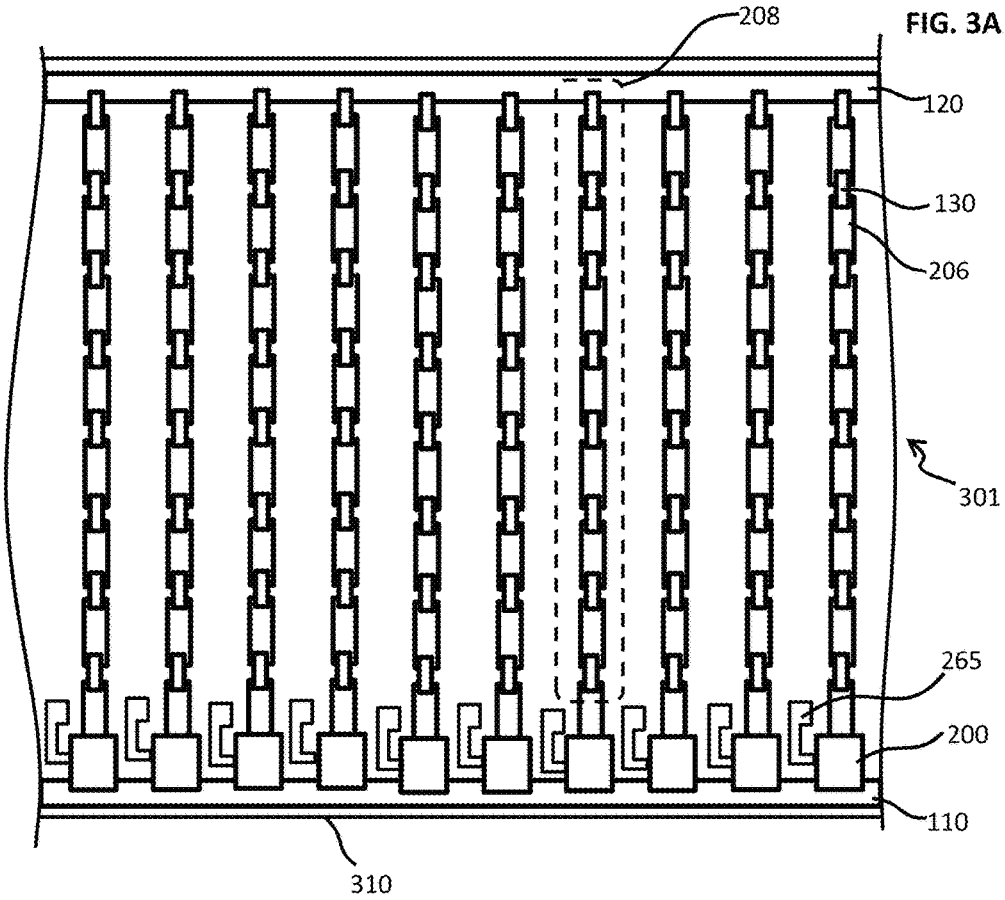
FIGS. 3A and 3B are schematic illustrations of lighting systems in accordance with various embodiments of the invention.
Figure 3B:
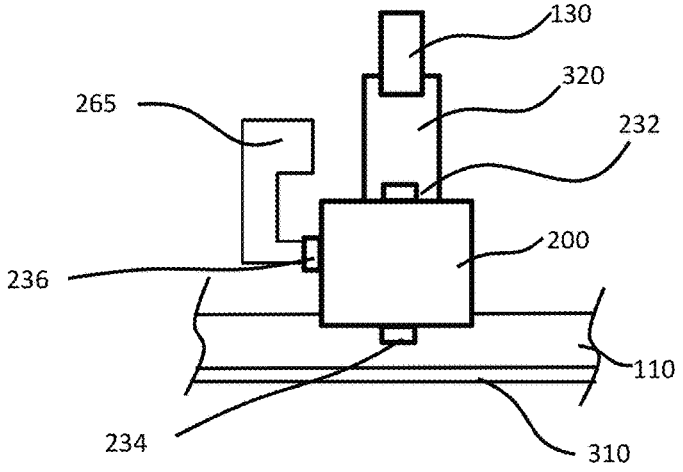

Referring to FIG. 3A, in various embodiments of the present invention a lighting system 301 features an array of LEEs 130 each electrically coupled between conductive traces 206, and power conductors 110 and 120 providing power to conductive traces 206 and PCEs 200, all of which are disposed over a substrate 310. As utilized herein, a "wiring board" refers to a substrate for LEEs with or without additional elements such as conductive traces or PCEs. A wiring board may also be referred to as a printed circuit board, a substrate, or a circuit board and may be flexible or rigid. FIG. 3B shows an enlarged portion of lighting system 301. In the exemplary embodiment depicted in FIG. 3A, power conductors 110, 120 are spaced apart from each other and light-emitting strings (or simply "strings") 208 are electrically coupled in parallel across power conductors 110, 120. In various embodiments, for example as shown in FIG. 3A, strings 150 do not cross (i.e., intersect) each other. In other words, power conductors 110, 120 are oriented in one direction and strings 208 are oriented such that they span power conductors 110, 120 in a different direction (e.g., substantially perpendicular, or at least not parallel, to the orientation of power conductors 110, 120). As shown in FIG. 3A, strings 208 are substantially perpendicular to power conductors 110, 120. However, this is not a limitation of the present invention, and in other embodiments at least some segments (i.e., portions connecting two or more LEEs 130), or even the entire strings 208, generally define a line that is not perpendicular to power conductors 110, 120 yet is (at least for an entire string 208) not parallel to power conductors 110, 120. In the example shown in FIG. 3A strings 206 are non-intersecting and do not cross each other. However, this is not a limitation of the present invention, and in other embodiments strings 208 may intersect, for example one string 208 splitting into two or more strings 208, or two or more strings 208 joining to form a reduced number of strings 208. In various embodiments, conductive elements 206 may cross over each other without being electrically coupled (i.e., while being electrically insulated from each other), and in some embodiments strings 208 may cross over or under each other.

As shown, LEEs 130 are positioned across substrate 310 in a regular periodic array, although this is not a limitation of the present invention, and in other embodiments LEEs 130 may occupy any positions on lighting system 301. Power conductors 110 and 120 provide power to each LEE string, for example the string 208 encircled by the dashed line in FIG. 3A. Each LEE string 208 typically includes multiple conductive traces 206 that interconnect multiple LEEs 130, to which are electrically coupled one or more PCEs 200, which in FIG. 3A is in series with LEEs 130. The number of strings 208 in lighting system 301 is not a limitation of the present invention.

FIG. 3B shows an enlarged portion of lighting system 301 containing PCE 200. As shown in FIG. 3B, connection point 232 of PCE 200 is electrically coupled to a conductive trace 320 that is electrically coupled to LEE 130, while connection point 234 is electrically coupled to power conductor 110. While PCE 200 in FIGS. 3A and 3B is shown at the end of the string of LEEs 130, as described herein, this is not a limitation of the present invention and in other embodiments PCE 200 may be electrically coupled to the string of LEEs 130 in different locations. Connection point 236, which may be used for programming or control of PCE 200, is electrically coupled to a test pad 265, for example in a fashion similar to that described in reference to FIG. 2C. In various embodiments of the present invention, each PCE 200 may be programmed or controlled through a test pad 265. As described herein, in various embodiments two or more test pads 265 may be electrically coupled together, for example to permit programming of the desired current level of multiple strings simultaneously.

In various embodiments of the present invention, a lighting system, for example one including or consisting essentially of one or more LEEs 130 and one or more PCEs 200 as shown in FIGS. 2B-2D or FIG. 3A, may be manufactured, and in various embodiments of the present invention one or more or all PCEs 200 may be pre-programmed or pre-set to a specific current value, and thus a specific resultant light intensity output value. In various embodiments of the present invention, if a different current valued is desired on one or more or all portions of the lighting system, PCEs 200 on that one or multiple or all portions may be programmed for that different current value, for example through connections 236. In various embodiments of the present invention, such programming may be done during manufacture of the lighting system; however, this is not a limitation of the present invention, and in other embodiments the lighting system may be manufactured and the current value, and thus light intensity level, may be programmed, if desired, after manufacture but before the lighting system is packaged and shipped to the customer or to the installation site or at the site of final installation, either during the installation time or at any subsequent time.

In various embodiments of the present invention, the lighting system may be tested, for example to verify the correct light intensity level, and in various embodiments the current may be programmed before such testing or as part of such testing processes. In various embodiments, the programming may be a one-time process, in which the current value may be set, either in a non-changeable or subsequently changeable fashion. In various embodiments of the present invention, the programming signal may be varied until the desired light intensity level is achieved, at which time the current value may be set, either in a non-changeable or subsequently changeable fashion.

In various embodiments of the present invention, lighting system 301 may be manufactured in a continuous or semi-continuous fashion, for example using roll-to-roll processing. In various embodiments of the present invention PCEs 200 may be pre-programmed or pre-set to a specific current value, and thus a specific light intensity output value. In various embodiments of the present invention, if a different current valued is desired on one or more portions of the continuous or semi-continuous roll or substrate, PCEs 200 on that one or multiple portions may be programmed for that different current value. In various embodiments of the present invention, such programming may be done during the roll-to-roll manufacture of the lighting system; however, this is not a limitation of the present invention, and in other embodiments the light sheet material may be manufactured and the desired current value, and thus light intensity level, may be programmed, if necessary, after roll-to-roll manufacture but before the light sheet is packaged and shipped to the customer or to the installation site or at the site of final installation, either during the installation time or at any subsequent time. In various embodiments of the present invention, the light sheet may be manufactured in a roll-to-roll process and PCEs 200 may be programmed, if desired, during various processes subsequent to the roll-to-roll manufacturing step, for example when the roll material is cut to length, or during attachment of various wires or connectors or during final testing.

In various embodiments of the present invention, lighting system 301 may be manufactured in roll-to-roll form, resulting in a roll of light sheet material with all PCEs 200 set at the default value and placed in inventory and upon receipt of an order, the desired amount of material may be removed from the roll and sent through various optional subsequent processing steps. In various embodiments of the present invention, the light sheet material, either in roll form or in sheet form, may be tested using an optical test system to verify conformance to optical requirements, such as light intensity, correlated color temperature (CCT) and the like. In various embodiments of the present invention, such a test system may also include a programming station, for example before the optical test station, to program PCE 200 to the desired value, which then optionally may be validated by the optical test system.

Such systems as described herein may permit economic manufacture of large amounts of light sheet material or lighting systems without the need for prior knowledge of the desired current value for the LEEs (in other words without the need for prior knowledge of the light output value) and the desired light output value programmed, if different from the default value, after manufacture of the light sheet material, for example after receipt of an order for the material or prior to or at the time of shipment.

Figure 3C:
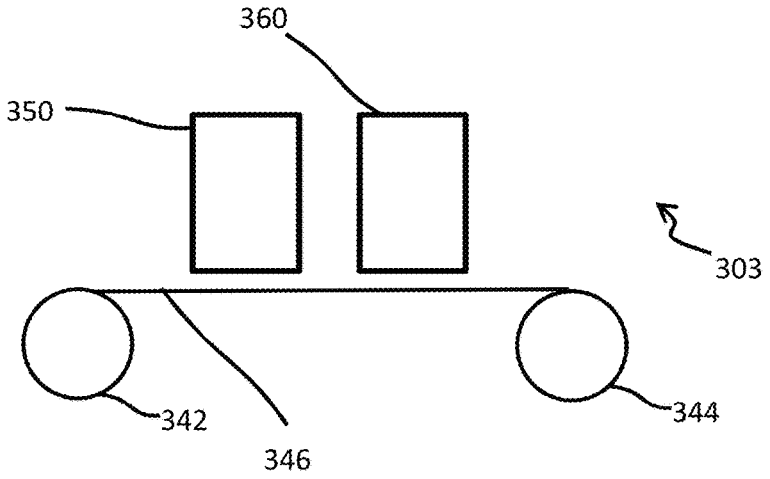
FIG. 3C is a schematic illustration of a fabrication system in accordance with various embodiments of the invention.

FIG. 3C shows a schematic diagram of an exemplary test system 303 in accordance with embodiments of the present invention. As shown, test system 303 includes or consists essentially of a supply roll 342, a take-up roll 344, and light sheet material or web 346 (including one or more of LEEs 130, PCE 200, conductive traces 206 test pads 265 or the like, not shown for clarity), as well as programming station 350 and test station 360. In various embodiments, web material 346 may include or consist essentially of a substrate over or on which are formed conductive traces and LEEs, for example like or similar to those shown in FIGS. 3A and 3B. While FIG. 3C shows test system 303 having two stations 350 and 360, this is not a limitation of the present invention, and in other embodiments test system 303 may have fewer or more stations and such stations may be configured in a different order. In various embodiments, test station 350 may include or consist essentially only of a programming station. In various embodiments, a programming station may include one or more probes that may be configured to electrically contact test pad 265 or connection point 236 to program PCE 200. In various embodiments, a system such as shown in FIG. 3C may be incorporated into the roll-to-roll manufacturing system for the light sheet material, for example including additional stations, for example to dispose LEEs 130 on web material 346, to pattern conductive traces 206 on web 346 or the like.

In an exemplary embodiment, PCE 200 may be configured to maintain a constant or substantially constant current through LEEs 130 of string 208. For example, in various embodiments, the constant voltage applied to power conductors 110, 120 may vary, or the sum of the forward voltages of LEEs 130 in different strings may be somewhat different, for example as a result of manufacturing tolerances or changes in temperature, or the components and/or operational values of the element(s) within PCE 200 may vary, for example as a result of manufacturing tolerances or changes in operating temperature, and PCE 200 acts to maintain the current through LEEs 130 substantially constant in the face of these variations. In other words, the input to the lighting system is a constant voltage that is applied to power conductors 110, 120, and PCEs 200 regulate the current to a constant or substantially constant value through LEEs 130. The design of PCE 200 may be varied to provide different levels of control or variation of the current through LEEs 130. In various embodiments, PCEs 200 may control the current through LEEs 130 to be substantially constant with a variation of less than about ±25%. In various embodiments, PCEs 200 may control the current through LEEs 130 to be substantially constant with a variation of less than about ±15%. In various embodiments, PCEs 200 may control the current through LEEs 130 to be substantially constant with a variation of less than about ±10%. In various embodiments, PCEs 200 may control the current through LEEs 130 to be substantially constant with a variation of less than about ±5%. In various embodiments, PCEs 200 may control the current through LEEs 130 to be substantially constant with a variation of less than about ±1%.

In various embodiments, as detailed herein, PCEs 200 may, in response to a control signal, act to maintain a constant or substantially constant current through LEEs 130 until instructed to change to a different constant or substantially constant current, for example by an external control or programming signal, for example coupled to connection point 236 or a different connection point. In various embodiments all PCEs 200 on a sheet may act in concert, that is maintain or change the current through all associated LEEs 130; however, this is not a limitation of the present invention, and in other embodiments one or more PCEs 200 may be individually instructed and/or energized.

Figure 3D:
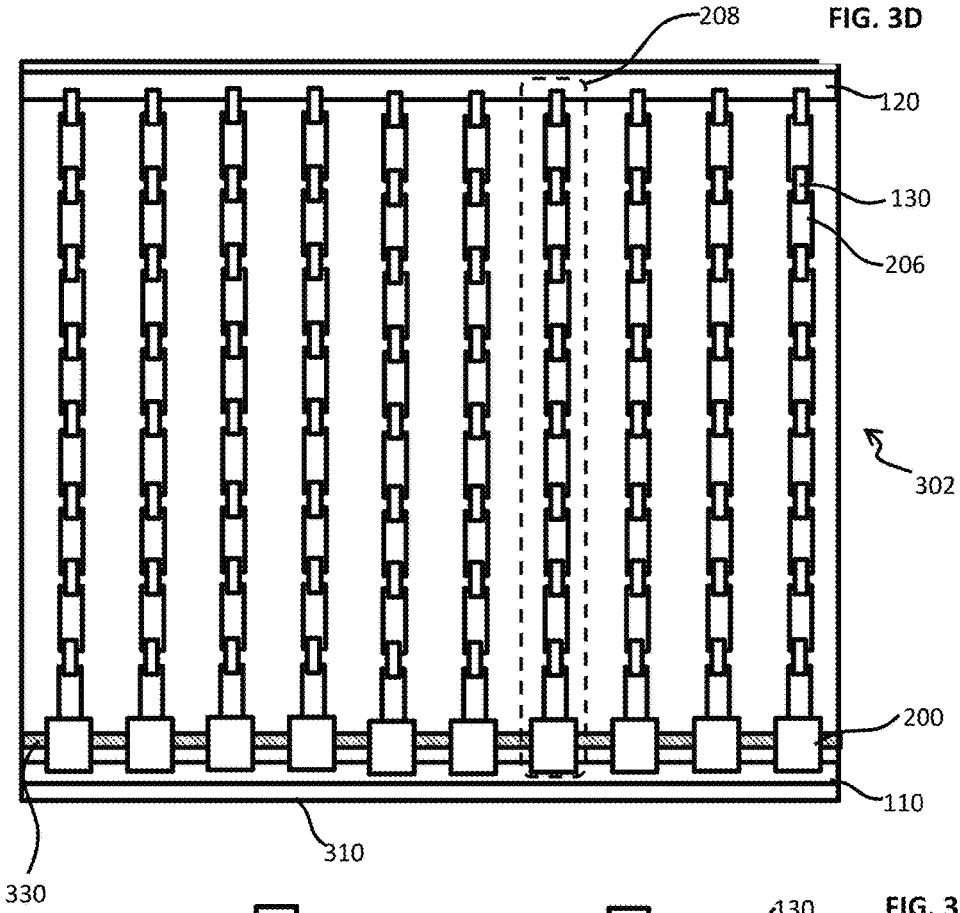
FIGS. 3D and 3E are schematic illustrations of lighting systems in accordance with various embodiments of the invention.
Figure 3E:
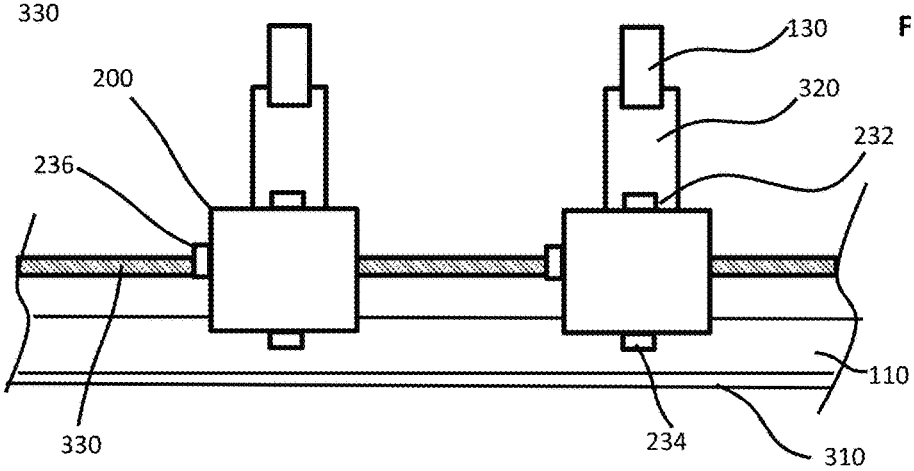

In various embodiments of the present invention, two or more connection points 236 for programming PCEs 200 may be coupled together, for example as shown in FIG. 3D. Lighting system 302 of FIG. 3D is similar to lighting system 301 of FIG. 3A; however, in the structure of lighting system 302, connection points 236 are electrically coupled together with conductor or conductive trace 330. FIG. 3E shows an enlarged portion of lighting system 302 of FIG. 3D, showing conductive trace 330 electrically coupled to connection points 236 of two different PCEs 200. In various embodiments of the present invention, multiple PCEs 200 may be programmed simultaneously with the same current value through conductive trace 330.

While lighting system 301 shown in FIG. 3A shows a portion of a larger or semi-continuous portion of a lighting system, lighting system 302 shown in FIG. 3D may represent a fixed-size lighting system. In various embodiments of the present invention, all strings 208 of a fixed-size lighting system 302 may be programmed simultaneously through conductive trace 330; however, this is not a limitation of the present invention, and in other embodiments each string may be programmed at different times. In various embodiments of the present invention, all strings in a lighting system may be programmed to the same current value; however, this is not a limitation of the present invention and in other embodiments, one or more strings or groups of strings may be programmed to have different current values.

In various embodiments, ME 220 may be configured to be able to be programmed to different values multiple times (i.e., ME 200 may be rewritable), while in other embodiments ME 220 may be configured to be programmed once, that is without the ability to be reprogrammed. For example, after installation, a maximum light intensity level may be programmed, either in a changeable way or permanently, into PCE 200. Subsequent to such programming, the light intensity level may be reduced by dimming the LEEs, as described herein.

While lighting system 302 is shown with connection points 236 from all PCEs 200 on lighting system 301 coupled together, this is not a limitation of the present invention, and in other embodiments a portion of a lighting system may have each PCE 200 separate or groups of PCEs 200 may be coupled together on lighting system 302.

In various embodiments of the present invention, LEEs 130 may be positioned on substrate 310 in a regular periodic array, for example having a fixed spacing or pitch between each LEE; however, this is not a limitation of the present invention, and in other embodiments LEEs 130 may be positioned in any pattern on substrate 310. In various embodiments of the present invention, PCE 200 may be positioned to fit within the pitch structure of the LEEs 130. In other words, the placement of PCE 200 may not change the pitch of the LEEs 130. In various embodiments, PCEs 200 may be located between any two arbitrary LEEs 130, not just at the end or beginning of a string 208, and PCE 200 has dimensions such that it fits between adjacent LEEs 130 spaced at the LEE pitch.

Figure 4:
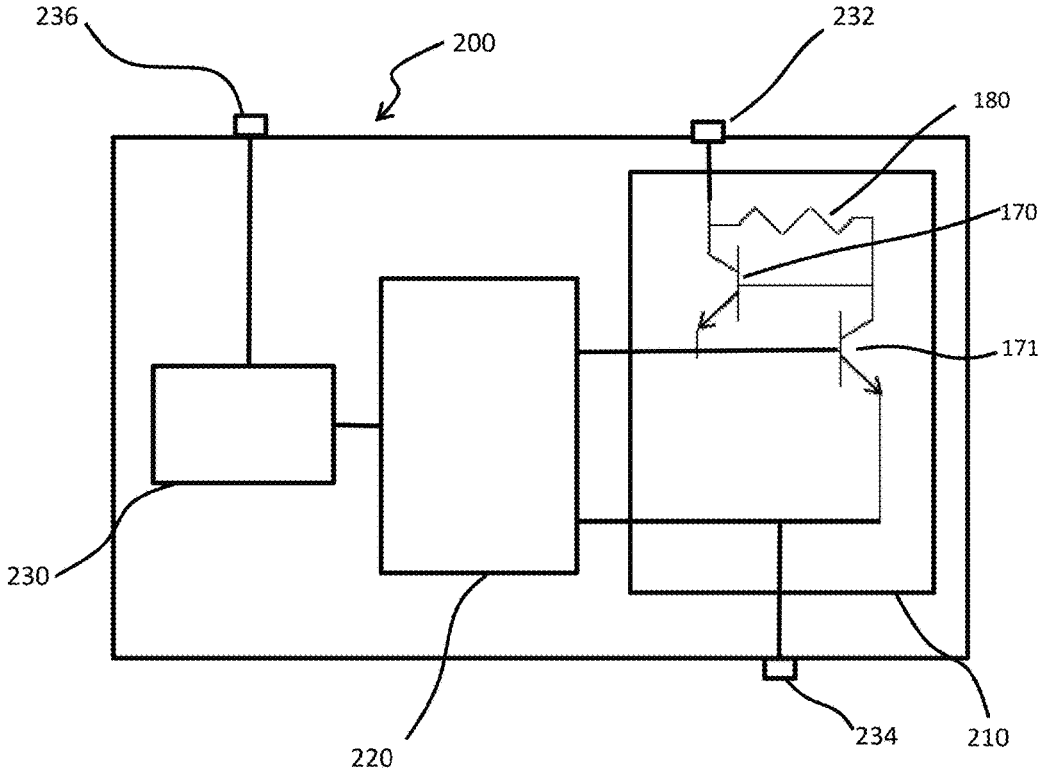
FIG. 4 is a schematic diagram of a programmable control element in accordance with various embodiments of the invention.

In various embodiments, CE 210 may include or consist essentially of a circuit composed of one or more active devices, for example a transistor or integrated circuit, and one or more passive devices, for example resistors, capacitors, and/or inductors. FIG. 4 shows an exemplary embodiment of a PCE 200 in which CE 210 includes or consists essentially of a circuit having two transistors and one resistor. In various embodiments of the present invention, ME 220 may include or consist essentially of a digital potentiometer, providing a resistance electrically coupled between the base of transistor 171 and connection point 234, while in other embodiments ME 220 may include or consist essentially of one or more components that provide a variable resistance electrically coupled between the base of transistor 171 and connection point 234, for example a FET configured as a variable resistance. In one example, BJTs 170, 171 are MMBT2484 manufactured by Fairchild Semiconductor, and resistor 180 has a value of about 39 kiloohms. In one example, the resistance between the base of transistor 171 and connection point 234 is about 113 ohms, to achieve a constant current of approximately 5 mA; however, this is not a limitation of the present invention, and in other embodiments the various resistors may have any value.

In various embodiments, current control in PCE 200 may be achieved using one or more circuits different from that shown in FIG. 4. For example, PCE 200 may include a more complex circuit incorporating improved thermal stability of the current, as are well known in the field. In various embodiments, setting or determination of the current value may be by means other than selection of a resistance value, for example by means of an analog voltage or a digital signal.

In various embodiments, PCE 200 includes or consists essentially of multiple components and such components may be in discrete form (i.e., each component individually electrically coupled to conductive traces 206) or in hybrid form (where multiple separate components are mounted on a submount, which is then electrically coupled to conductive traces 160), or in monolithic form (where multiple components are integrated on a semiconductor chip, for example a silicon-based or other semiconductor-based integrated circuit). In various embodiments, PCE 200 may be in bare-die form, while in other embodiments PCE 200 may be packaged or potted or the like. In various embodiments, PCE 200 may include or consist essentially of a bare-die integrated circuit. In various embodiments, the integrated circuit includes or consists essentially of multiple active and/or passive devices that are fabricated on a common semiconductor substrate.

In various embodiments, power conductors 110, 120 may provide AC power, or power modulated at different frequencies and in these embodiments PCEs 200 may be selected accordingly or may be omitted. In various embodiments, power conductors 110, 120 may provide a standard line voltage, for example about 120 VAC or about 240 VAC or about 277 VAC, for example at about 50 Hz or about 60 Hz. In various embodiments, PCE 200 may accommodate a plurality of input types, a so-called "universal" PCE 200, while in other embodiments different PCEs 200 may be used for different input types. The actual component or components of PCEs 200 are not limiting to this invention.

In various embodiments, each PCE 200 may have an address or identifier, for example in a lighting system incorporating more than one PCE 200, each PCE 200 may have its own unique address, or two or more PCEs 200 may share the same address. Addressable PCEs 200 may permit variation of the current and thus light output level by group of LEEs or strings of LEEs in a static or dynamic fashion. In various embodiments of the present invention, the addressing may be accomplished using the same connection point and wire or conductive trace as the control, for example using conductive trace 330 that connects multiple PCE2 200 in the lighting system of FIG. 3D, while in other embodiments addressing may be performed using other connection points. In various embodiments, a single-wire communication system/protocol may incorporate both address information and dimming information. In various embodiments, the system may support addressing (i.e., sending an address and dimming or other information to a particular PCE and the PCE receiving and implementing that information) at a rate of about 10 Hz, about 100 Hz, about 1 kHz, about 10 kHz, about 100 kHz or any arbitrary rate. (Here rate means the number of different PCEs that can be addressed and programmed in a unit time, for example a rate of about 1 kHz means that about 1000 different PCEs may be addressed and programmed in about 1 second.)

In various embodiments, the address or identifier may also be utilized to selectively set or program the current value in the PCE. In various embodiments, PCEs may be addressed and programmed at a rate of about 2 Hz, about 10 Hz, about 100 Hz or about 1000 Hz, about 100,000 Hz or any arbitrary rate.

Figure 5A:
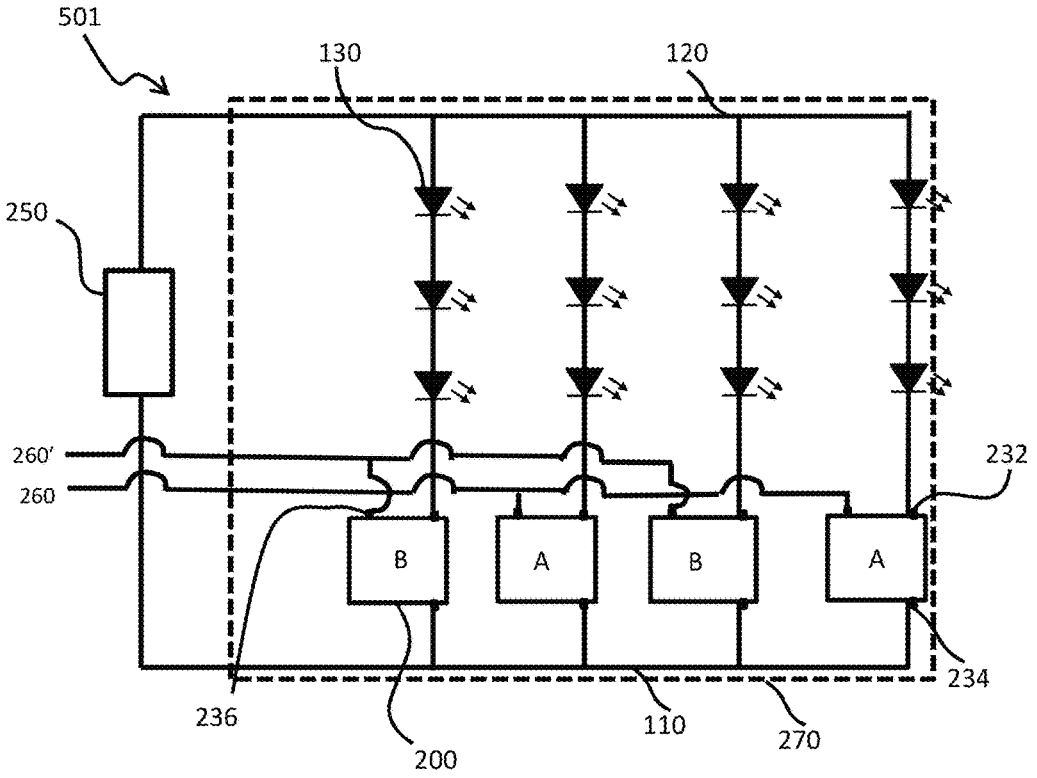
FIGS. 5A-C are schematic illustrations of lighting systems in accordance with various embodiments of the invention.

FIG. 5A shows a lighting system 501 in accordance with various embodiments of the present invention. The system of FIG. 5A includes four strings; however, the number of strings is not a limitation of the present invention, and in other embodiments fewer or more strings may be used. In the system of FIG. 5A two strings identified or addressed as "A" are associated with control signal (or control line) 260, while two strings identified or addressed as "B" are associated with control signal 260'. In various embodiments, each control signal or address may be associated with fewer or more than two strings. In various embodiments, strings A and B may include similar or identical LEEs 130, for example permitting changing the intensity or turning strings A off or on independently from strings B. In various embodiments of the present invention, strings A and B may include different LEEs 130, for example LEEs having different correlated color temperatures (CCT) or colors or color points of white light, for example cool or warm white light, or may include different colored LEEs 130. For example, in various embodiments LEEs 130 associated with strings or address A may have a relatively warm color temperature in the range of about 1200K to about 3000K, and LEEs 130 associated with strings or address B may have a relatively cool color temperature in the range of about 4500K to about 10,000K, and control signals 260 and 260' may be varied to permit variation in the color or color point of the light emitted by the system between the color temperatures of the LEEs associated with strings A and B.

In various embodiments of the present invention, strings or addresses A and B may have differences other than the color of LEEs 130, for example they may have different spectral power density, spatial intensity distribution, color rendering index CRI, R9 or the like or may have different accessories such as diffusers, optics, lenses, filters or the like, and control signals 260 and 260' may be varied to permit variation in one or more of these characteristics. While the system shown in FIG. 5A includes two different string types (A and B) this is not a limitation of the present invention, and in other embodiments more than two different string types may be utilized. In various embodiments, a lighting system may include three channels, one channel each for red, green, and blue LEEs 130, or a four-channel system with one channel each for red, green, blue, and white LEEs 130, to provide for color lighting systems, for example for displays, lighting scenes, advertising signage, or the like.

Figure 5B:
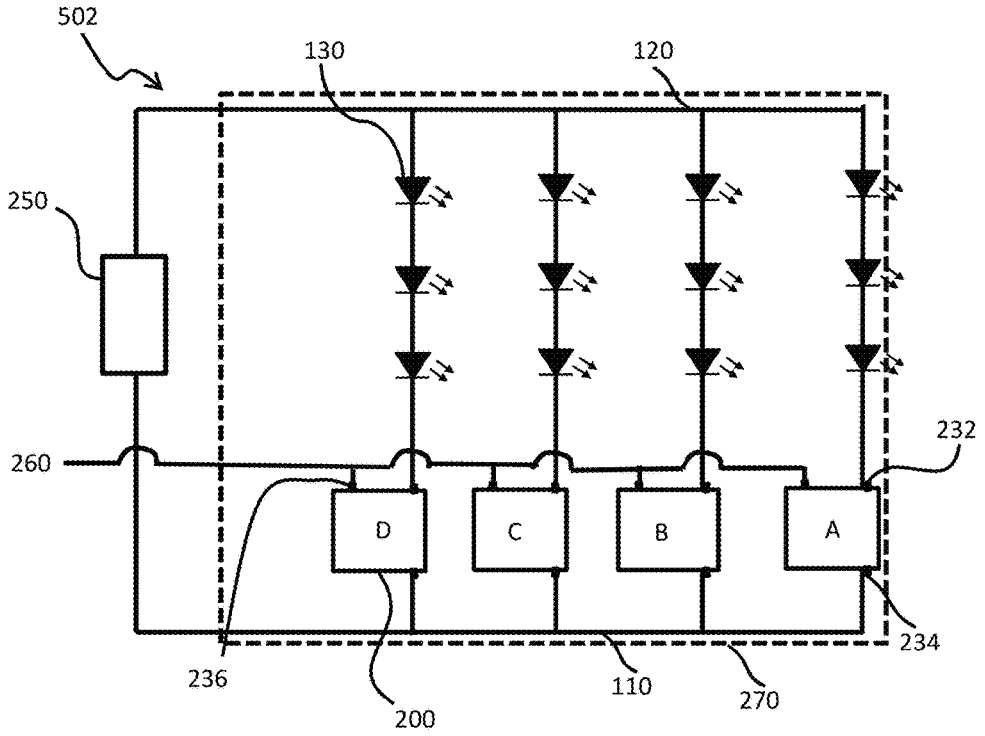

FIG. 5B shows a lighting system 502 in accordance with various embodiments of the present invention. The system of FIG. 5B includes four strings; however, the number of strings is not a limitation of the present invention, and in other embodiments fewer or more strings may be used. In the system of FIG. 5B each string has a different identification or address (A-D); however, this is not a limitation of the present invention and in other embodiments two or more strings may have the same identification, for example they may be identical or substantially identical strings. As shown in FIG. 5B, each string is electrically coupled to a common control signal (or control line) 260 which provides information, for example for LEE 130 intensity level, by address to each PCE 200. Such information provision may be static, for example one-time, or may be dynamic, for example varying one or more times over time, for example for dimming the intensity of LEEs 130 electrically coupled to PCE 200. For example, at a given time PCE address A may have a relative intensity level signal of about 0, PCE address B may have a relative intensity level signal of about 25%, PCE address C may have a relative intensity level signal of about 45%, and PCE address D may have a relative intensity level signal of about 95%. In various embodiments, the relative intensity level may vary between about 0% and about 100%. While FIG. 5B shows four channels or addresses (A-D), this is not a limitation of the present invention, and in other embodiments fewer or more channels or addresses may be utilized. For example, in various embodiments, a lighting system may have 20 channels, 100 channels, 1,000 channels, 1,000,000 channels, or any number of channels. As discussed with reference to the lighting system of FIG. 5A, other embodiments of lighting systems of the present invention may include multiple channels of white and/or colored LEEs 130, to provide for color lighting systems, for example for displays, lighting scenes, advertising signage, or the like.

In various embodiments, the control signal may change the relative intensity level of each string as a function of time, for example once a second, 30 times per second, 100 times per second, 1000 times per second, 3000 times per second, or with any other frequency.

In various embodiments, LEEs 130 associated with different addresses may have different color temperatures, for example different CCTs or color points of white light (for example cooler or warmer white light), and control signal 260 may provide information to each address to vary the CCT. In various embodiments, LEEs 130 may have different colors, for example red, green, blue, and/or white, and control signal 260 may provide information to each address to display a varying color scene, a video scene, or the like.

In various embodiments of the present invention, the different addresses may have differences other than the color of LEEs 130; for example, they may have different spectral power density, spatial intensity distribution, color rendering index, R9, or the like, and appropriate control of control signals 260 may permit variation in one or more of these characteristics. While the system shown in FIG. 5B includes four different addresses, this is not a limitation of the present invention, and in other embodiments more than two different string types may be utilized.

Figure 5C:
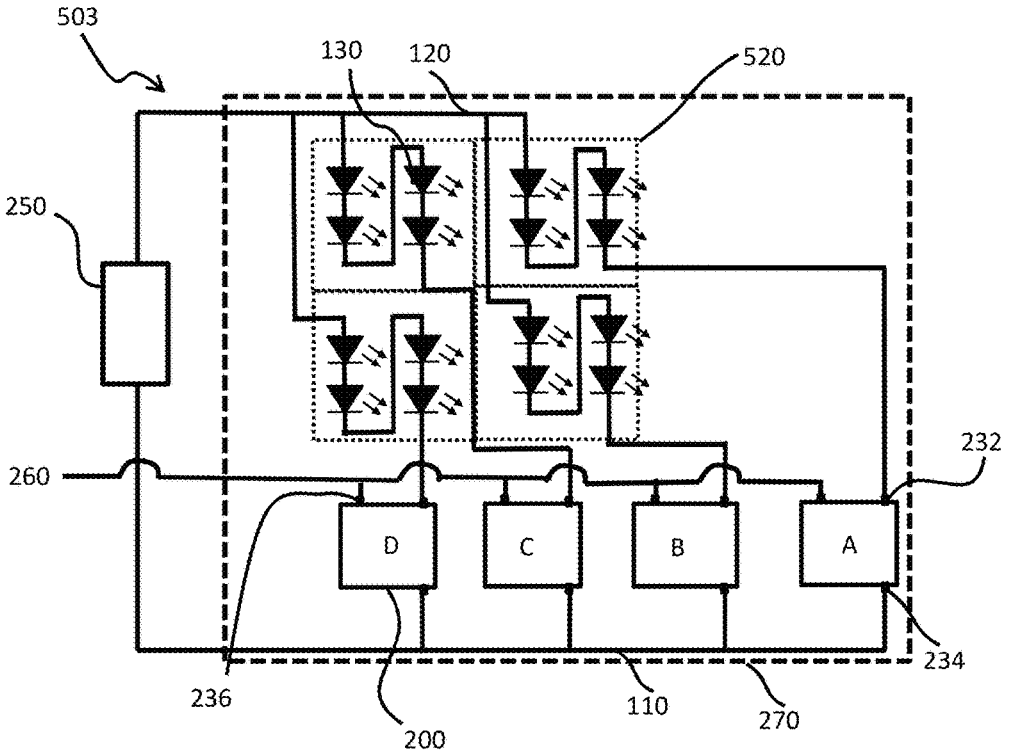

While FIGS. 5A and 5B show LEEs 130 arranged in one or more linear strings, this is not a limitation of the present invention, and the physical layout may be different than the electrical schematic. FIG. 5C depicts a lighting system 503, which is similar to lighting system 502 of FIG. 5B; however, LEEs 130 in each string are arranged in a 2×2 array, identified as a cell 520. In various embodiments, a lighting system may include or consist essentially of many cells 520. In various embodiments, cells 520 may be positioned in a periodic array, as shown in FIG. 5C; however, this is not a limitation of the present invention, and in other embodiments cells 520 may be positioned in any geometry or configuration. While FIG. 5C shows four LEEs 130 per cell 520, this is not a limitation of the present invention, and in other embodiments fewer or more than four LEEs 130 may be included in each cell 520.

Figure 1A:
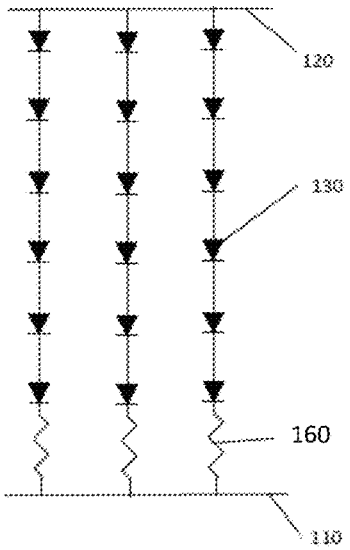
FIG. 1A PRIOR ART
FIGS. 1A and 1B are schematic illustrations of portions of electrical configurations of lighting systems.
Figure 1B:
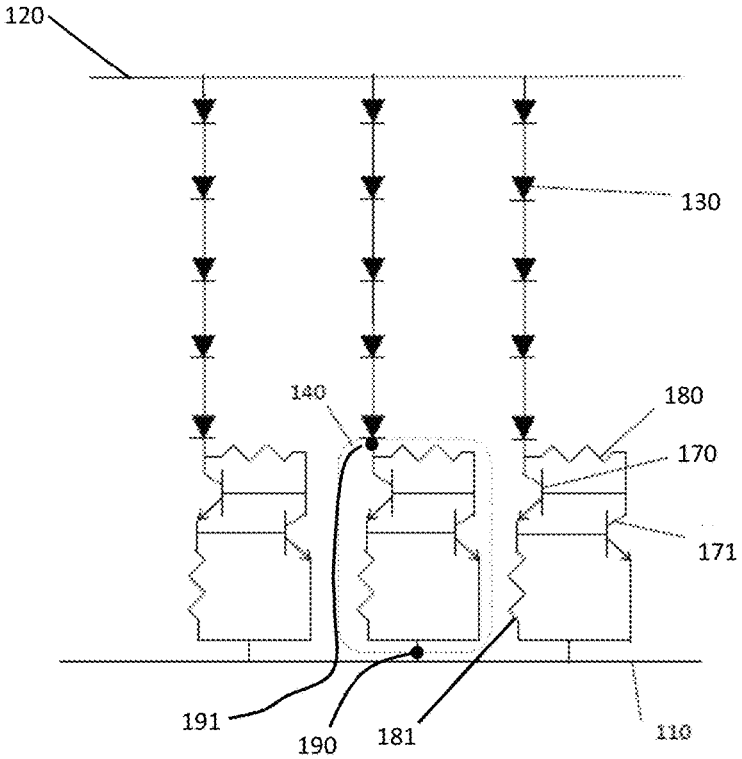
FIG. 1B PRIOR ART
Figure 6A:
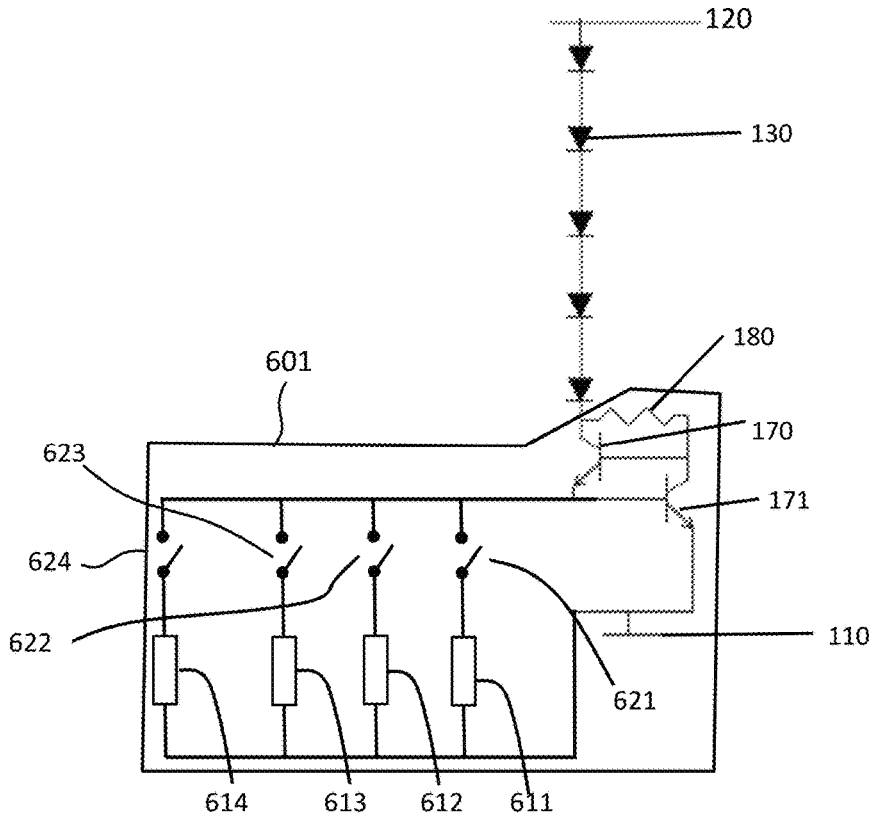
FIGS. 6A-6E and 7 are schematic illustrations of lighting systems in accordance with various embodiments of the invention.

FIG. 6A shows a partial schematic diagram of a PCE 601 in accordance with various embodiments of the present invention—note that the schematic diagram of FIG. 6A, for clarity, does not show the memory elements or communication elements present in programmable control elements in accordance with embodiments of the invention such as PCE 601; rather, FIG. 6A emphasizes only the control-element functionality of PCE 601. In PCE 601 the current set resistor 181 of FIG. 1B is replaced by switches 621-624 and associated resistors 611-614. In various embodiments, the current through the LEEs and thus the LEE intensity may be set by closing one or more of switches 621-624 to achieve the desired current set resistance value. In various embodiments of the present invention, the memory element 220 of PCE 601 includes, consists essentially of, or consists of the switches 621-624 themselves.

In various embodiments of the present invention, switches 621-624 and resistors 611-614 are integrated into one package. In various embodiments of the present invention, the switches and resistors may be integrated into a single semiconductor chip; however, this is not a limitation of the present invention, and in other embodiments the resistors and switches may be separate, but incorporated into a single package.

In various embodiments, switches 621-624 may include, consist essentially of, or consist of programmable switches. For example, in various embodiments switches 621-624 may include, consist essentially of, or consist of fusible links, fuses, anti-fuses, or the like. In various embodiments, each of the switches 621-624 may include, consist essentially of, or consist of an anti-fuse. In such embodiments, the switches are initially open, as shown in FIG. 6A, and one or more links or connections are "made" or shorted to close each switch. In various embodiments of the present invention, only one resistor is selected; however, this is not a limitation of the present invention, and in other embodiments more than one link may be a closed link and more than one resistor may be selected. In various embodiments of the present invention, selection of more than one resistor may provide more possible current and intensity variations than if only one resistor is selected at a time. For example, in the case of four switches, if only one is selected at a time, this permits four choices of current, while if any number may be selected, up to 16 combinations are possible.

In various embodiments of the present invention, all of the switches may be initially closed, and one or more switches opened to select a resistor or a resistance value. In either case, when more than one switch is closed, two or more resistors are in parallel and the value of the current set resistor is determined by the parallel combination of the selected resistors.

In various embodiments of the present invention, programming of the PCE may be performed in less than about 1 second, or less than about 0.5 seconds, or less than about 0.1 seconds, or in any other time period.

In various embodiments of the present invention, switches 621-624 may be one-time fusible links, i.e., once the switch is either closed or open, its configuration may not be changed. In various embodiments of the present invention, such one-time programmable (OTP) switches may include, consist essentially of, or consist of a conductive link that may be cut or disrupted, for example a metal link that may be programmatically opened by melting the metal, for example through application of high power or high current to the link. In various embodiments, such metal links may include, consist essentially of, or consist of aluminum; however, other metals may also be used, as well as other materials, for example polysilicon or other fusible materials. In various embodiments, a one-time switch may include, consist essentially of, or consist of a micro-electrical mechanical system (MEMS) switch configured for one-time operation. In various embodiments, such a OTP switch may include, consist essentially of, or consist of an antifuse, where an open circuit is closed, for example as used in EPROM devices in which electrical charge is injected into a floating gate to connect the source and drain of a field effect transistor (FET) acting as a switch.

Figure 6B:
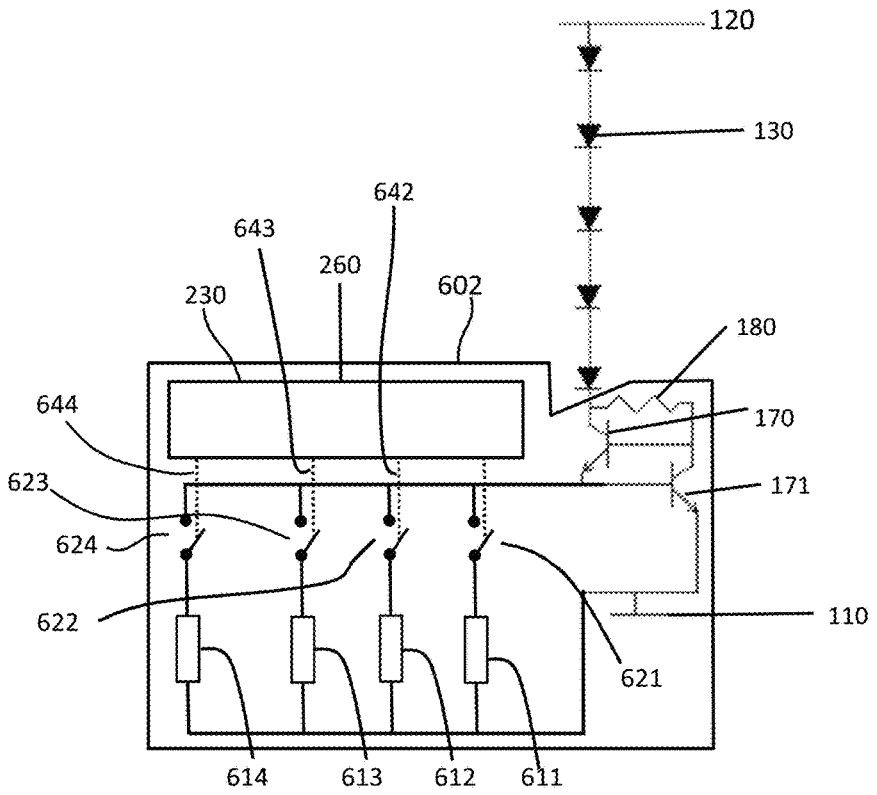

FIG. 6B is a schematic diagram of a PCE 602 in accordance with various embodiments of the present invention that includes, consists essentially of, or consists of switches 621-624 and communication or programming element 230. In various embodiments, communication element 230 may be programmed through a programmable interface 260 to set the positions of switches 621-624. In various embodiments, instructions for switch settings are sent via programming interface 260 (which many include, consist essentially of, or consist of one or more communication channels, for example wired, wireless or other) to communication or programming element 230 to convert the programming signal to control signals for the switches. In various embodiments, a non-volatile memory element (not separately shown in FIG. 6B) may be included in communication element 230, to provide a fixed signal to switches 621-624 over control lines 641-644; however, this is not a limitation of the present invention, and in other embodiments switches 621-624 may themselves be non-volatile, as described herein and programming/communication element 230 is used only for programming the switch positions.

In various embodiments, COMME 230 may include, consist essentially of, or consist of one or more modules that support a communication protocol, for example 1-Wire, Up/Down, $I^2C$, SPI, Serial, Parallel, Ethernet, Bluetooth, WiFi, or the like. (These communication protocols may be synchronous, asynchronous, single master or multi master, half duplex, full duplex, peer, multi-drop, or multi-point.) In various embodiments, COMME 230 may include, consist essentially of, or consist of hardware (for example electronic circuitry) and/or software. In various embodiments of the present invention, the function of COMME 230 is to translate an external communication signal to usable information for use by PCE 200; thus, in various embodiments COMME 230 may include, consist essentially of, or consist of a microcontroller, microprocessor, look-up table, and/or other circuitry to translate the external communication signal to a commands or information within PCE 200, for example to provide a desired current value, to provide a specific address of a PCE 200, to set or fix the desired current value in non-volatile memory, to provide a desired dimming level or the like. The specific type or circuitry of COMME 200 is not a limitation of the present invention. Referring to FIG. 6B, in various embodiments COMME 230 includes, consists essentially of, or consists of a communication portion or module) to receive information from an external control system, and may use one or more of a standard or proprietary communication protocol (the specific communication protocol is not a limitation of the present invention) and a programming function (or module), for example digital logic, analog logic, a microcontroller, microprocessor, a look-up table, or the like that takes the information from the communication portion and translates it into programming commands for switches 621-624. For example, in various embodiments switches 621-624 may include, consist essentially of, or consist of a fuse, and the programming command may include, consist essentially of, or consist of a signal or one or more pulses of power to blow (cause the fuse to be open-circuit) the fuse to program it, or switches 621-624 may include, consist essentially of, or consist of a floating gate transistor, and the programming command may include, consist essentially of, or consist of a signal or one or more pulses of current to inject charge into the floating gate to cause the switch to be closed (to pass current), or a signal of one or more pulses of power to remove the "erase" or remove the charge from the floating gate.

In various embodiments, the functionality of COMME 230, ME 220, and/or CE 210 may be physically separate elements or components, as implied by the schematic of FIG. 2A; however, this is not a limitation of the present invention, and in other embodiments the functionality of COMME 230, ME 220, and/or CE 210 may be merged or shared by various hardware and/or software elements.

In various embodiments, PCE 602 may include, consist essentially of, or consist of a digital potentiometer, in which the resistor value is determined by a digital input to the programming interface 260. In various embodiments, a digital potentiometer may include, consist essentially of, or consist of an array of discrete resistors that may be switched in or out of the attached circuit; however, this is not a limitation of the present invention, and in other embodiments the different resistance values may be achieved through use of an electronic circuit, for example a FET acting as a resistor. In various embodiments, the schematic diagram of PCE 602 in FIG. 6B may represent a resistor-based digital potentiometer, where resistors 611-614 represent actual resistors and switches 621-624 are controlled by control element 230 through control lines 641-644 and control element 230 includes a non-volatile memory element (not separately shown in FIG. 6B) that retains the value of control signals 641-644 even if power is removed from PCE 602.

Figure 6C:
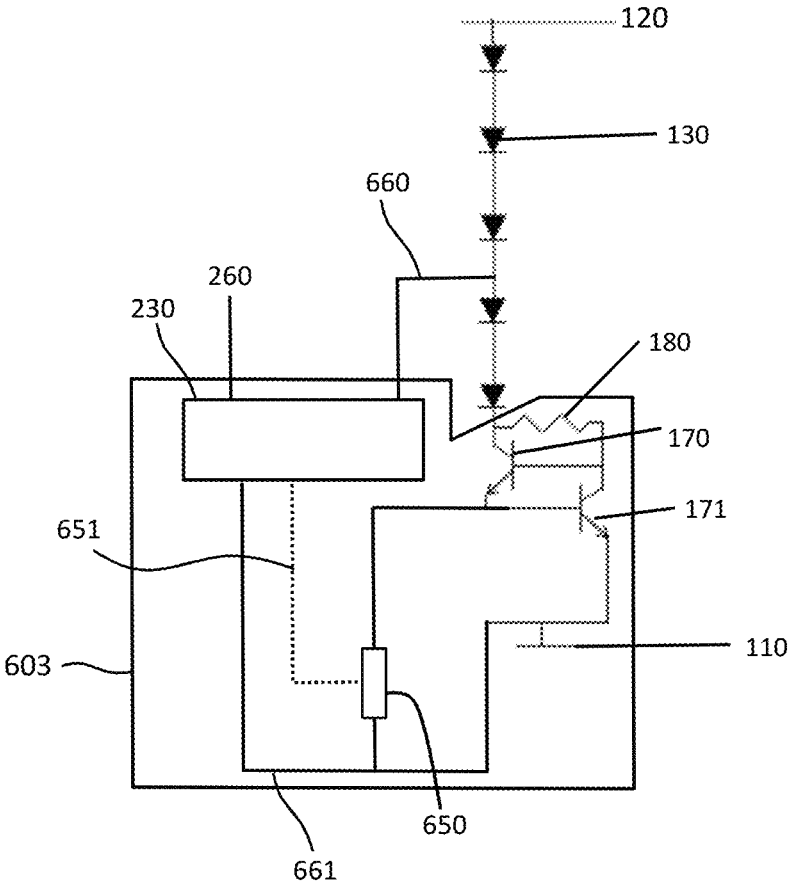

In various embodiments of the present invention, resistors 641-644 may be replaced by a variable resistance element 650, for example an element that exhibits a change in resistance in response to a control signal 651, as shown in FIG. 6C for PCE 603. In various embodiments, the variable resistance element may include, consist essentially of, or consist of one or more field effect transistors (FETs), one or more junction FETs (JFETs), and/or one or more metal oxide semiconductor FETs (MOSFETs). In various embodiments, the value of control signal 651 is determined by the instructions provided to communication element 230 over programming interface 260.

While not shown in FIGS. 6A and 6B, power for PCE 601 and 602 may be provided separately from that for the lighting system, or may be provided from the power source for the lighting system, for example from power conductors 120 and 110. In FIG. 6C, power is provided to PCE 603 through power lines 660 and 661. While power line 660 is shown as being taken at a point within the string of LEEs 130, this is not a limitation, and in other embodiments power line 660 may be powered from other points within the LEE 130 string or from power conductor 120 directly. In various embodiments, the voltage applied to power line 660 may be varied by tapping off of different positions in the LEE 130 string. In various embodiments, tap positions closer to power conductor 120 may have a relatively higher voltage than positions farther away from power conductor 120, with a voltage increment between LEEs 130 being about the value of the forward voltage of the LEEs 130 at their operating current.

Figure 6D:
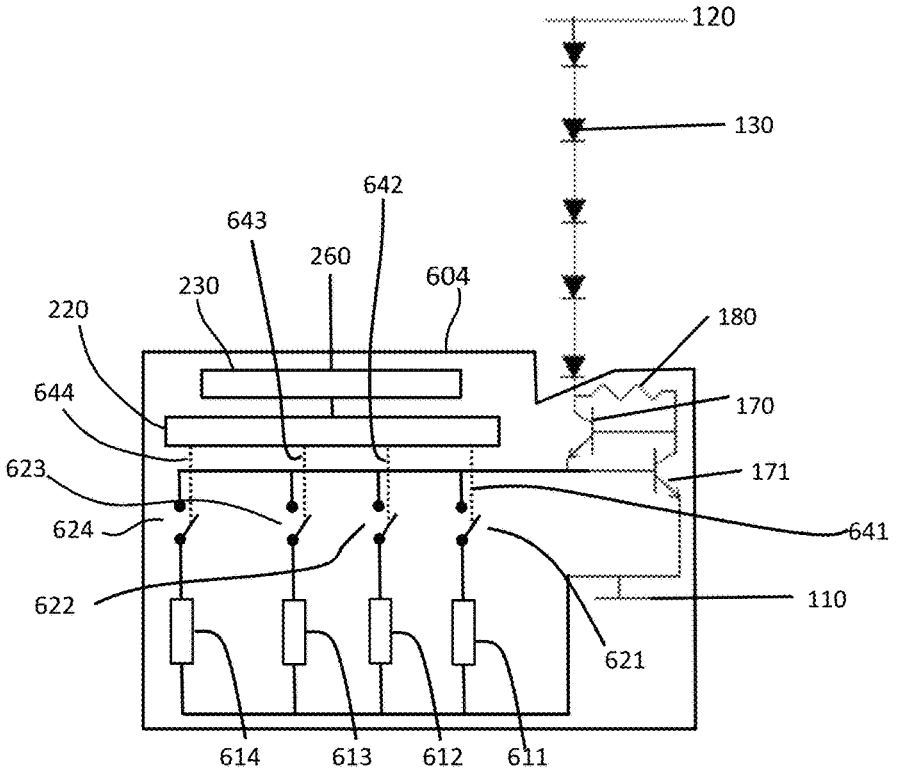

FIG. 6D is a schematic diagram of a PCE 604 in accordance with various embodiments of the present invention. PCE 604 is similar to PCE 602 of FIG. 6B; however, in PCE 604 communication unit 230 provides the communication function while memory element 220 provides the non-volatile memory function that permits retention of the desired current value even if power is removed from PCE 604. In various embodiments of the present invention memory unit 220 may include, consist essentially of, or consist of one or more non-volatile memory types that are well known in the area of non-volatile memory (e.g., flash memory). In various embodiments, memory unit 220 may include or consist of a programmable read only memory (PROM), that is electrically programmable for example by burning or blowing fuses or other links to permanently set the value of each memory bit and thus such a system is an example of a one-time programmable (OTP) non-volatile memory, that is it may only be programmed once.

In various embodiments, memory element 220 may include, consist essentially of, or consist of a erasable programmable read only memory (EPROM), that is electrically programmable for example by injecting charge into floating gate transistors to retain the desired information even without power. In various embodiments EPROMs may be re-programmed by erasing the previous information through exposure to UV light or with an electrical erasure signal, i.e., as in an electrically erasable PROM (EEPROM).

In various embodiments, memory element 220 may include, consist essentially of, or consist of one or more types of other non-volatile memory, for example NOR Flash, NAND flash, non-volatile static random access memory (nvSRAM), ferroelectric random access memory (FeRAM), magnetoresistive random access memory (MRAM), phase change memory (PCM), or any other type of non-volatile memory.

In various embodiments of the present invention, communication element 230 provides an interface between the PCE and an external programmer or controller. In various embodiments communication element 230 may utilize a one-input or one-wire interface, permitting the PCE to have only one contact or pin on the package dedicated to communication. A variety of one-wire communication protocols may be used, the specific type is not a limitation of the present invention. For example, such a one wire interface could be an up/down interface, in which a signal on the wire is used to increment or decrement the switch position, the 1-Wire system designed by Dallas Semiconductor, or other one-wire protocols.

Figure 6E:
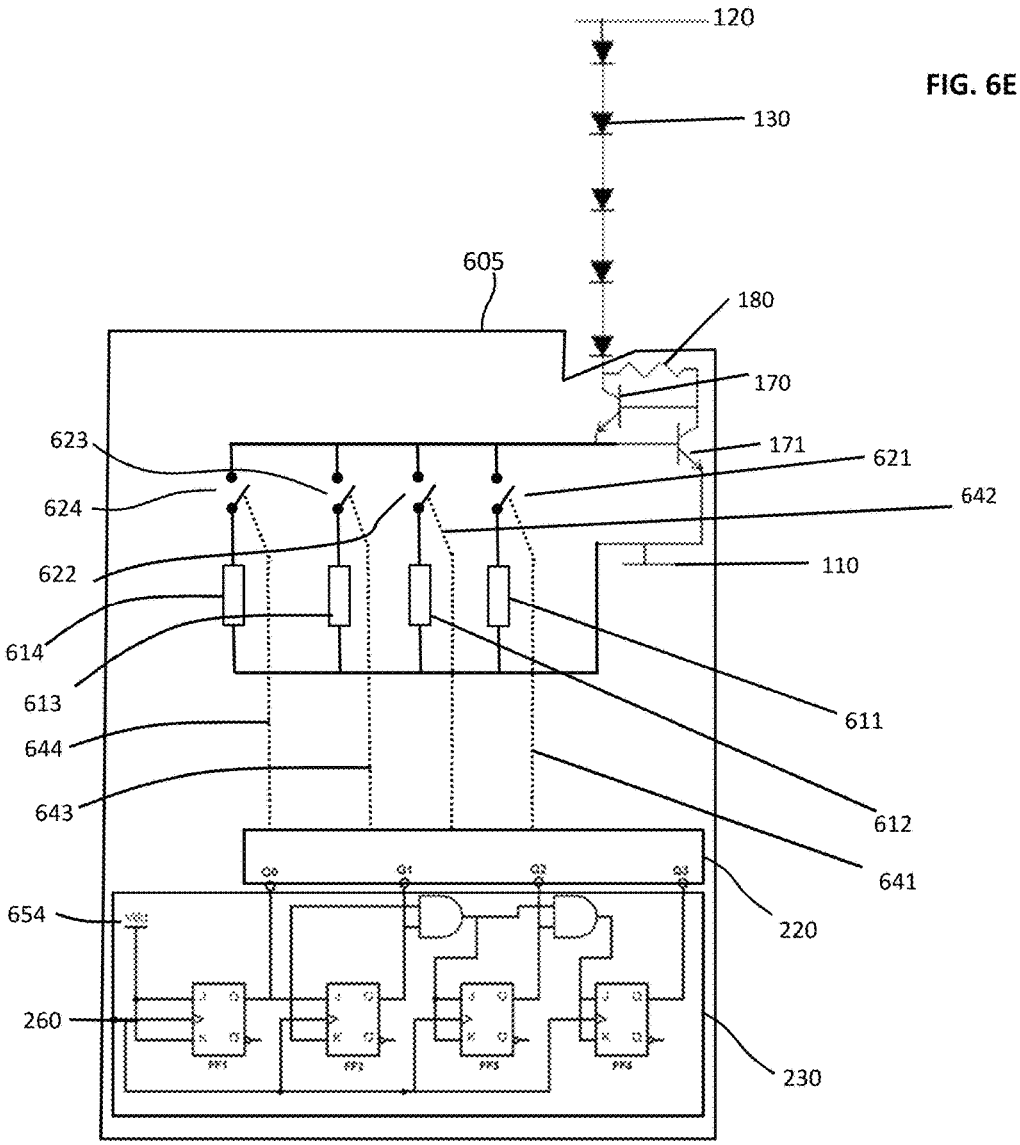

In various embodiments of the present invention, a one-wire interface may include, consist essentially of, or consist of an up/down interface. FIG. 6E is a schematic diagram of a PCE 605 in accordance with various embodiments of the present invention, which includes an up/down communication element 230. The up/down communication element includes, consists essentially of, or consists of a series of flip flops connected as a counter. By applying pulses to communication interface 260 (the input of the counter), the values of bits Q0 to Q3 count up from 0000 to 1111 and then repeat. Each bit Q0 to Q3 is stored in non-volatile memory 220, providing a constant signal to switches 621 to 624. In various embodiments, communication interface 260 may provide a write or set signal (not shown in FIG. 6E) to memory element 220, to write the data from Q0 to Q3 into the non-volatile memory of memory element 220.

In various embodiments of the present invention, a one-wire interface may include, consist essentially of, or consist of a 1-Wire interface. This interface protocol is commercially available and utilized by a number of manufacturers, for example Maxim Integrated, Microchip and Texas Instruments.

In various embodiments of the present invention, interfaces having more than two wires or inputs may be utilized, for example $I^2C$, SPI, Serial, Parallel, or the like; however, the specific interface protocol or the number of inputs or wires required by the interface protocol is not a limitation of the present invention.

While FIGS. 6A, 6B, 6D, and 6E show resistors 611-614 in parallel, this is not a limitation of the present invention, and in other embodiments other resistor configurations may be utilized. While system 601 shows four switches 621-624 and four resistors 611-614, this is not a limitation of the present invention, and in other embodiments fewer or more resistors and/or switches may be used. For example, a system similar to that of system 601 may include, consist essentially of, or consist of 10 pairs of switches and resistors or 50 pairs of switches and resistors or any number of pairs of switches and resistors. While the system of FIG. 6A shows a current control circuit including two transistors and one resistor (excluding the current set resistor), this is not a limitation of the present invention, and in other embodiments any current control circuit may be utilized.

As discussed herein, in various embodiments of the present invention LEEs 130 may be dimmed, for example to provide a variation of the intensity below the maximum set by the desired current set in the PCE. In various embodiments of the present invention, such dimming may be accomplished by modulating the power to the lighting system, for example pulse-width modulating the power from power supply 250 in the lighting system of FIG. 2C; however, this is not a limitation of the present invention, and in other embodiments dimming may be accomplished by other means.

In various embodiments of the present invention, pulse-width modulation of the power to the lighting system will result in modulation of the power to the PCE, for example when the PCE is powered directly or indirectly from power supply 250. In various embodiments of the present invention, the operation of current control element 210 may not be affected by power modulation. For example, the current control circuit shown in FIG. 1B is not affected or is not substantially affected by power modulation and in fact is designed to be operated with power modulation, providing current regulation while modulating the power supplied to the lighting system.

Figure 7:
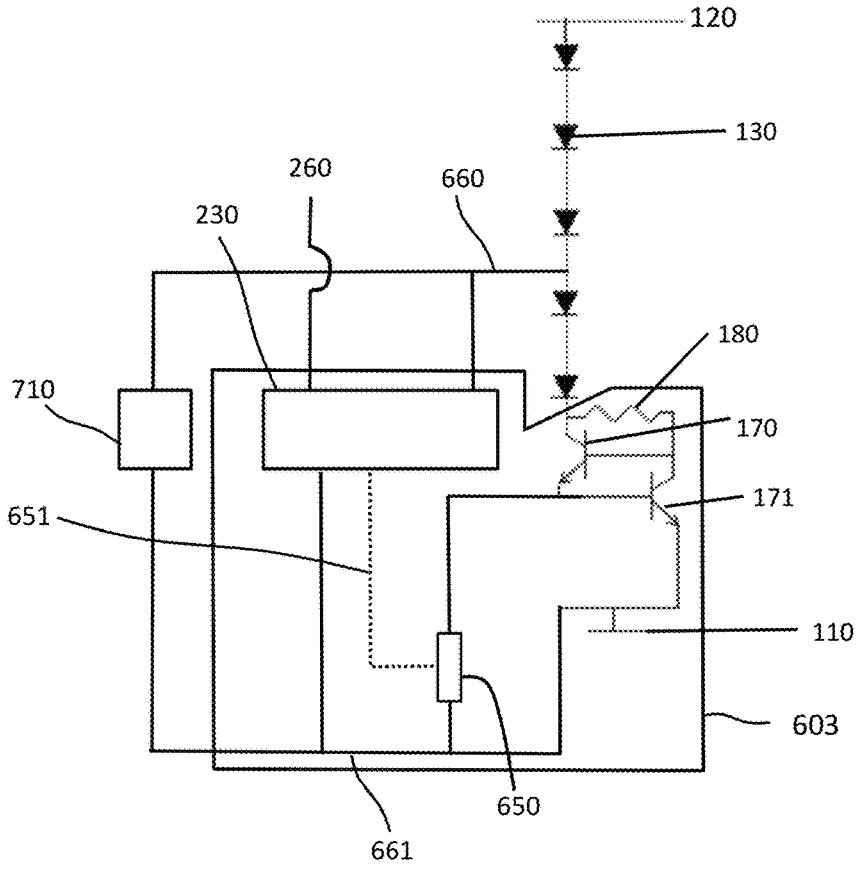

In various embodiments of the present system, current control element 210 may include circuitry or components that have a turn-on or stabilization time that is appreciable compared to the on-time of the modulated power, resulting in possible unacceptable current regulation if the power to the current control element is modulated. In various embodiments, such possible unacceptable current regulation may be manifested as flickering or delayed turn on, particularly with relatively low duty cycles (i.e. dimming to low intensities). In such embodiments, possible unacceptable current regulation may be reduced or eliminated by inclusion of an energy storage component 710 with current control element 210, for example as shown in FIG. 7. In various embodiments energy storage component 710 may include, consist essentially of, or consist of a capacitor, a super capacitor, and/or one or more other energy storage components. In various embodiments, the energy storage component may be sized to be able to provide power to current control element 210 during at least a portion of the period when the power supply is off, during the modulation cycle of the power supply.

FIG. 8A shows a diagram of an exemplary current control circuit, which in various embodiments may provide improved stability of the current level, for example as a function of temperature or input power $V_{IN}$. In various embodiments, a reference voltage 810 is applied to the positive input of operational amplifier (op amp) 805 that is representative of the desired current in LEEs 130. The voltage across resistor 830 is applied to the negative input 820 of op amp 805, and op amp 805 adjusts its output to the base of transistor 807 to bring the negative input 820 (resistor 830 voltage) equal to the positive input (voltage reference 810), with the current through LEEs 130 calculated as about the value of the voltage reference applied to input 810 divided by the value of resistor 830, with the assumption that the collector and emitter currents of transistor 807 are substantially equal, which is a reasonable assumption for a relatively high gain transistor 807.

In various embodiments of the present invention, op amp 805 may be designed to exhibit less temperature dependence than individual transistors as used in the circuit of FIG. 1B, thus providing a more stable LEE current in the face of temperature variations. As described herein, the circuit of FIG. 1B may also be susceptible to relatively small current variations with variations in the voltage across the current control circuit. In contrast, op amps may have relatively stable characteristics in the face of power supply variations (for example as applied to terminals 840 and 845 of op amp 805), and thus variations in $V_{IN}$ may have relatively smaller impact on the current through LEEs 130 than in the circuit of FIG. 1B. In various embodiments, terminal 840 may be electrically coupled to $V_{IN}$ and terminal 845 may be electrically coupled to ground as shown in FIG. 8A; however, this is not a limitation of the present invention, and in other embodiments terminals 840 and 845 may have different connections. For example, in various embodiments terminal 840 may be electrically coupled to a point between LEEs 130 in the string of LEEs, as described in reference to FIG. 7. Finally, the reference voltage 810 may be sourced from a circuit or control system having relatively high temperature stability, thus further improving the temperature stability of the circuit.

In various embodiments, the circuit of FIG. 8A may have a relatively slower turn-on time compared to the circuit of FIG. 1B. For example, the circuitry of op amp 805 may have a slower turn-on time than that of the individual transistors in the circuit of FIG. 1B. Furthermore, the circuit of FIG. 8A features a feedback loop through op amp 805, and in various embodiments a relatively longer time may be required, upon application of $V_{IN}$, for the circuit of FIG. 8A to power up and provide a stable current through LEEs 130. In various embodiments where dimming is achieved by modulation of $V_{IN}$, this may cause undesirable effects such as flicker or slow response times when $V_{IN}$ is only on for times comparable or shorter than the circuit stabilization time.

FIG. 8B shows an exemplary comparison of LEE current and $V_{IN}$ for relatively long 851 and short 861 $V_{IN}$ modulation times. In FIG. 8B, periods 850 and 860 represent two different periods of modulation of $V_{IN}$, in which period 850 is the same or substantially the same as period 860 and the modulation frequency is given as about the reciprocal of period 850 or 860. Duty cycle 851 represents the duty cycle of $V_{IN}$ in period 850, which is relatively longer than the duty cycle 861 of $V_{IN}$ in period 860. As shown in FIG. 8B, LEE current 852 has a turn-on transient, a constant portion, and a turn-off transient. For period 850, the turn-on and turn-off transient times are relatively short compared to the duty cycle 851, and thus the LEE current is constant over most of duty cycle 851. In contrast, during period 861, the LEE current waveform is shaped more like a spike and in various embodiments, for such low duty cycles, this may result in flashing of flickering of the light from LEEs 130. In various embodiments, the turn-on transients may be somewhat different in each period, possibly resulting in additional optically visible artifacts.

In various embodiments of the present invention, dimming may be accomplished via means other than modulation of the input power $V_{IN}$. In various embodiments, the current through LEEs 130 may be modulated by a separate modulation device, for example a switch, transistor or the like, for example placed in series with LEEs 130; however, this is not a limitation of the present invention, and in other embodiments the modulation device may have different locations in the circuit. In various embodiments, the modulation device may include, consist essentially of, or consist of a FET.

FIG. 8C shows a current control circuit similar to that described in reference to FIG. 8A, with the addition of a modulation device 808, in accordance with various embodiments of the present invention. Modulation device 808 modulates the current through current set resistor 830, resulting in the current through LEEs 130 having the same or substantially the same modulation. For example, in various embodiments of the present invention modulation device 808 may be switched off and on by modulation signal 870 with varying duty cycle, for example a pulse-width modulated duty cycle, resulting in a substantially similar modulation of the current through LEEs 130. Thus, modulation signal 870 acts as a dimming signal for the circuit of FIG. 8C without modulating $V_{IN}$ to perform the dimming function. While FIG. 8C shows modulation device 808 as a FET, this is not a limitation of the present invention, and in other embodiments modulation device may be a bipolar junction transistor or any other device(s). In various embodiments, signal 870 may include, consist essentially of, or consist of a pulse-width modulated signal; however, this is not a limitation of the present invention, and in other embodiments the modulation method may be different. In various embodiments of the present invention, modulation signal 870 may be communicated to the PCE through programming signal 260. In various embodiments of the present invention, modulation signal 870 may be communicated to the PCE through programming signal 260, where programming signal includes, consists essentially of, or consists of a one-wire communication protocol.

FIG. 8D shows an exemplary current control circuit in accordance with various embodiments of the present invention. The circuit of FIG. 8D includes, consists essentially of, or consists of op amp 805 driving transistor 807 to force the voltage at the negative input 820 of op amp 805 to the same value as the voltage at the positive input 810 of op amp 805. The voltage at positive input 810 of op amp 805 is determined by the output voltage of voltage reference 874 that is driven by bias supply 872. The output of op amp 805 drives the base of transistor 807, the collector of which drives the base of transistor 809, determining the current from $V_{IN}$ to be supplied to LEEs 130 and resistor 830. This sets the value of the voltage across resistor 830, which is applied to negative input 820 of op amp 805. Because op amp 805 acts to force the voltage at negative input 820 equal to the voltage at positive input 810 (which is equal to the output voltage of reference voltage 874), the current in LEEs 130 has a value of voltage reference voltage divided by the value of resistor 830. In this circuit there is no transistor in series with LEEs 130 and resistor 830, as there is in the circuits of FIGS. 8A and 8B, and thus the current through LEEs 130 is the same as that through resistor 830, whereas in the case of the circuits of FIGS. 8A and 8B, the current through LEEs 130 is smaller than the current through resistor 830 by about the amount of the base current of transistor 807.

Voltage reference 874 may provide a relatively stable voltage as a function of temperature, thus reducing temperature induced variations of the current in LEEs 130. In various embodiments, voltage reference 874 may include, consist essentially of, or consist of a Zener diode or a Zener diode in combination with one or more circuit elements, for example resistors, transistors, capacitors, op amps, or the like. In various embodiments, bias supply 872 may provide power to voltage reference 874. In various embodiments, power to voltage reference 874 may be modulated, for example by modulation signal 870, to perform dimming of LEEs 130. In various embodiments of the present invention, signal 870 may include, consist essentially of, or consist of a pulse-width modulated signal. When signal 870 is off, the voltage at positive input 810 of op amp 805 is about zero or substantially zero; thus, op amp 805 drives transistors 807 and 809 to turn off current to LEEs 130, reducing the voltage across resistor 830 to zero or about zero. When signal 870 is on, the circuit works as described herein, driving the current through LEEs 130 to the desired value set by current set resistor 830. In various embodiments, bias supply 872 may include a modulation device similar to modulation device 808, as described in reference to FIG. 8C, for example a FET that turns power off and on to voltage reference 874.

Figure 8E:
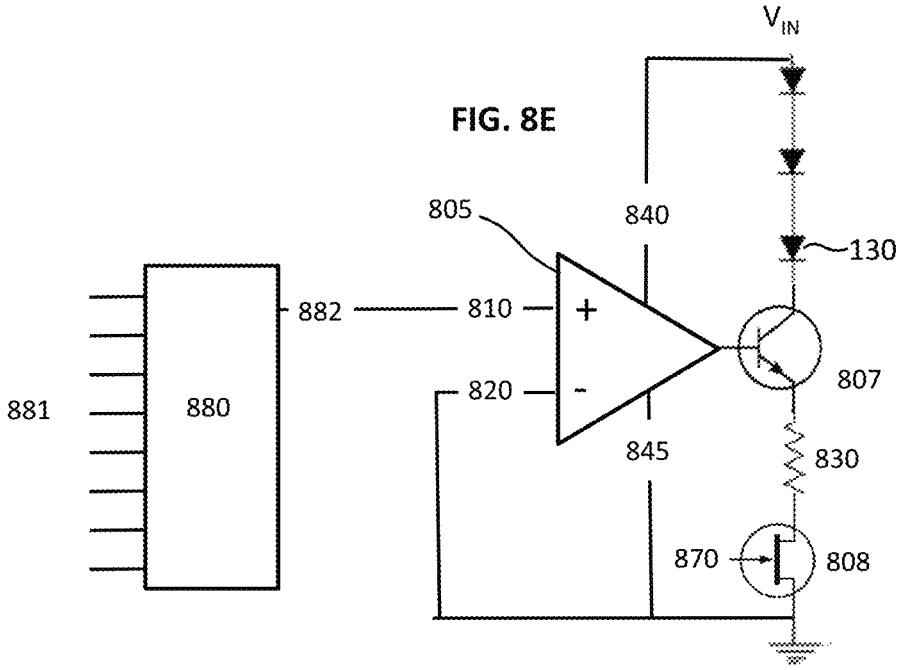

In various embodiments, the reference voltage applied to positive input 810 of op amp 805 may be a fixed voltage reference circuit as described herein; however, this is not a limitation of the present invention, and in other embodiments a reference voltage may be obtained by other means. FIG. 8E shows an exemplary circuit in accordance with embodiments of the present invention in which the voltage reference includes, consists essentially of, or consists of a digital to analog converter (DAC) 880 having binary inputs 881 and an analog voltage output 882 that is electrically coupled to input terminal 810 of op amp 805. In various embodiments, binary input 881 may be provided from a non-volatile memory, for example memory element 220. In various embodiments, binary inputs may be provided by a microcontroller or microprocessor having a non-volatile component permitting retention of the desired information to output the required binary values to achieve the desired LEE 130 current value.

In various embodiments, DAC 880 may provide a fixed voltage to input 810 of op amp 805, and resistor 830 may be varied to set the current, as described herein; however, this is not a limitation of the present invention, and in other embodiments resistor 830 may be kept constant and the voltage applied to the positive input of op amp 805 may be varied to set the desired current. For example, in various embodiments, the programmability may be achieved by utilizing a fixed voltage reference in combination with a means for varying the value of the current set resistor, while in other embodiments programmability may be achieved by utilizing a fixed resistor in combination with a means for varying the reference voltage. In various embodiments, the means for varying the value of the current set resistor or the means for providing a variable voltage reference may incorporate a non-volatile memory element, such that the reference value, for example the resistance or the voltage reference value, is maintained even if power is removed from the system.

In various embodiments, DAC 880 may include, consist essentially of, or consist of any type of digital to analog converter circuits or types known to those skilled in the field of digital to analog converter circuit design, for example pulse width modulation into a low-pass filter, binary weighted conversion using resistors, capacitors or current sources, R/2R ladder, successive approximation, oversampling or the like, and the specific type of digital to analog conversion is not a limitation of the present invention.

FIGS. 8A and 8C-8E show exemplary current control circuits; however, these are not limitations of the present invention, and in other embodiments other current control circuits or circuit topologies as may be known to those skilled in the design of such circuits. As discussed herein, the current set resistor in various embodiments of the present invention, which schematically shown as a resistor, for example in circuits 8A, 8B and 8D, may be replaced by a non-volatile resistance value or non-volatile representation of the resistance value.

Figure 8F:
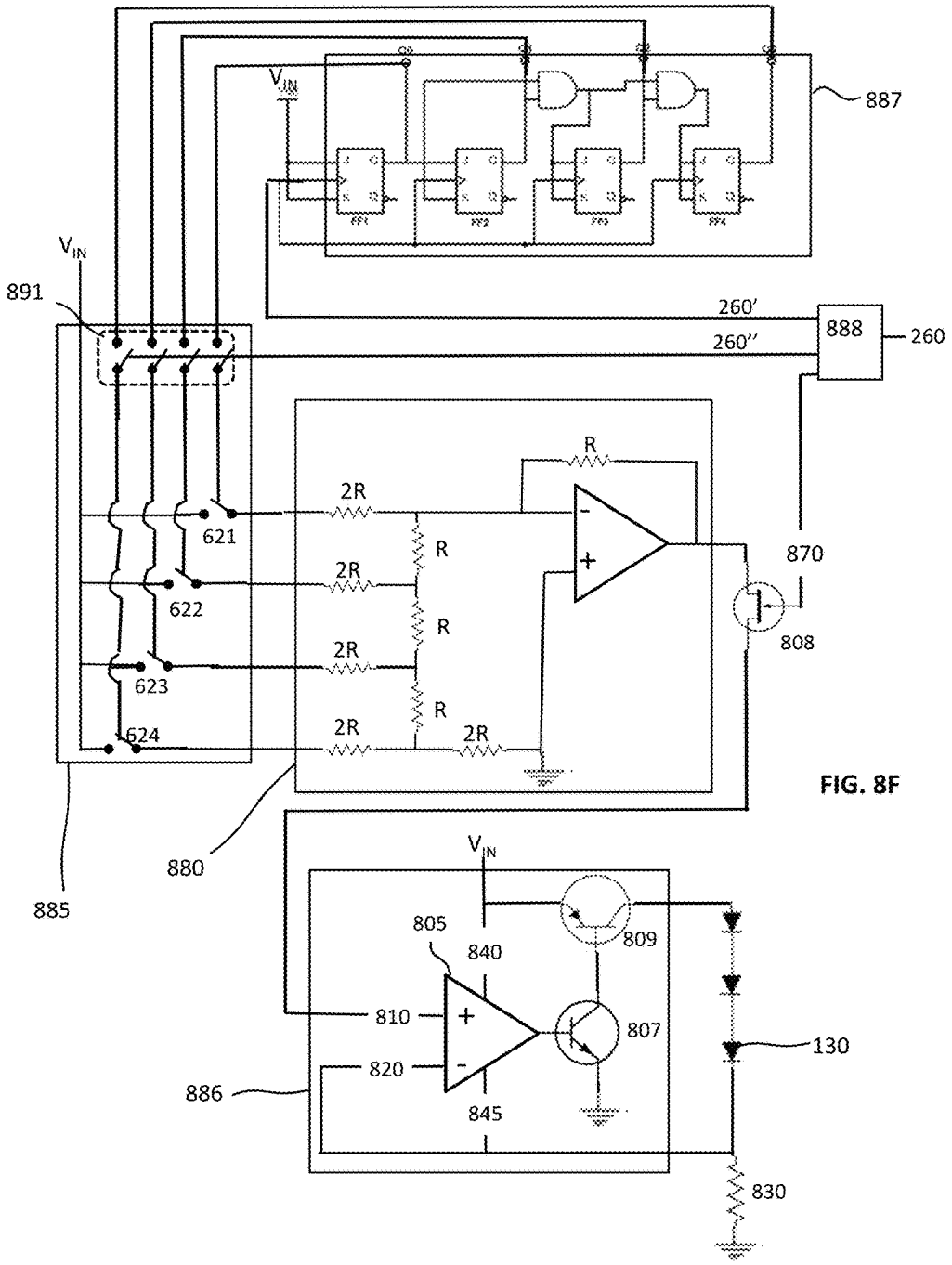
FIG. 8F is a schematic illustration of a lighting system in accordance with various embodiments of the invention.

FIG. 8F shows an exemplary circuit schematic of a programmable current control chip in accordance with embodiments of the present invention. The circuit of FIG. 8F includes, consists essentially of, or consists of communication port 888, digital logic section 887, memory element 885, DAC 880 and current control element 886. In various embodiments of the present invention, communication port 888 may provide consolidation of the required information signals into one or more communication signals 260. For example, in the circuit of FIG. 8F information signal 260' may be used to set the digital representation of the desired current level, for example as described in reference to FIG. 6E, information signal 260" may be used to gate the digital representation of the desired current level to memory element 885 through gate switches 891, and information signal 870 may be used to provide a dimming signal for LEEs 130. In various embodiments, memory element 885 may include, consist essentially of, or consist of fusible links 621-624, and the signals from digital logic section 887 may be used to open such links as determined by information signal 260', upon closing of gating switches 891 as controlled by information signal 260". Once the fusible links are set, $V_{IN}$ is selectively applied to the binary inputs of DAC 880 as determined by which of fusible links 621-624 are open or shorted. As shown in FIG. 8F, DAC 880 is a R2/2R ladder type DAC; however, this is not a limitation of the present invention, and in other embodiments DAC 880 may be of other types, as described herein. In various embodiments, the output of DAC 880 may be modulated by modulation device 808. After passing through modulation device 808, the output of DAC 880 is provided to the input of current control element 886, the operation of which is described in reference to FIGS. 8A, 8C, and 8D. The circuit of FIG. 8F provides the ability to, in a non-volatile way, program a desired current value, and control the current through electrically coupled LEEs 130 to the programmed value. In various embodiments of the present invention, all of the components and/or elements shown may be incorporated into a single package, with the exception of LEEs 130.

While the circuit of FIG. 8F utilizes specific circuitry for the various functional elements, these are not limitations of the present invention, and in other embodiments other circuitry may be utilized. For example, in various embodiments, instead of a one-time programmable memory element 885, a non-volatile memory element that may be programmed two or more times may be substituted for memory element 885. In various embodiments, digital logic 887 may be replaced by a microcontroller, microprocessor, other digital logic, or other means of providing the desired functionality. In various embodiments, other types of digital-to-analog converters may be utilized instead of R/2R ladder type DACs.

Figure 9A:
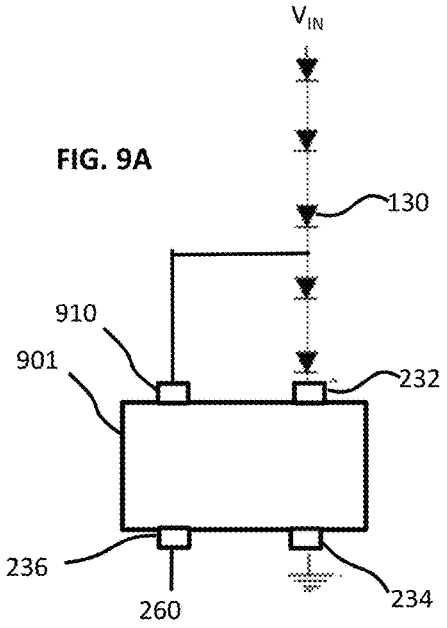
FIGS. 9A-9G are schematic illustrations of lighting systems in accordance with various embodiments of the invention.

FIGS. 9A-9G show exemplary configurations of single-package PCEs 901 and 902 in lighting systems in accordance with various embodiments of the present invention. In various embodiments, PCE 901 and 902 include, consist essentially of, or consist of a single package that includes all of the circuitry and functionality required. In various embodiments, PCE 901 includes power connection point 910, communication connection point 236, and connection points 232 and 234 for connection to LEEs 130. The circuit configuration of FIG. 9A shows LEEs 130 electrically coupled to PCE 901 on the "high side" between connection point 232 and V. In this embodiment, power for PCE 901 is taken from the LEE string, two LEEs 130 away from connection point 232 and connection point 234 is electrically coupled to ground.

Figure 9C:
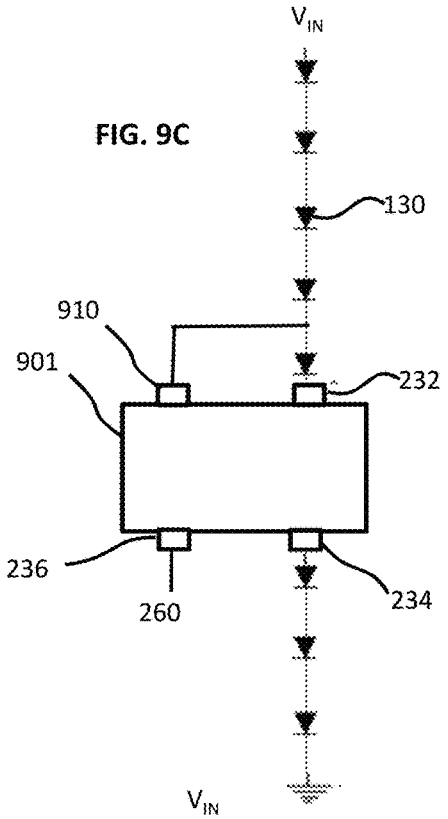
Figure 9B:
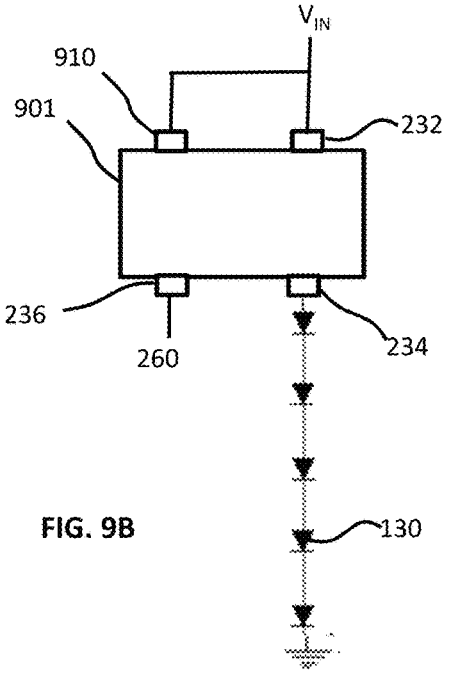

The circuit configuration of FIG. 9B shows LEEs 130 electrically coupled to PCE 901 on the "low side" between connection point 234 and ground, and connection point 232 is electrically coupled to $V_{IN}$. In this embodiment, power for PCE 901 is taken directly from $V_{IN}$.

The circuit configuration of FIG. 9C shows LEEs 130 electrically coupled on both the "high side" between connection point 232 and $V_{IN}$ and on the "low side" between connection point 234 and ground. In this embodiment, power for PCE 901 is taken from the LEE string, one LEE 130 away from connection point 232.

Figure 9D:
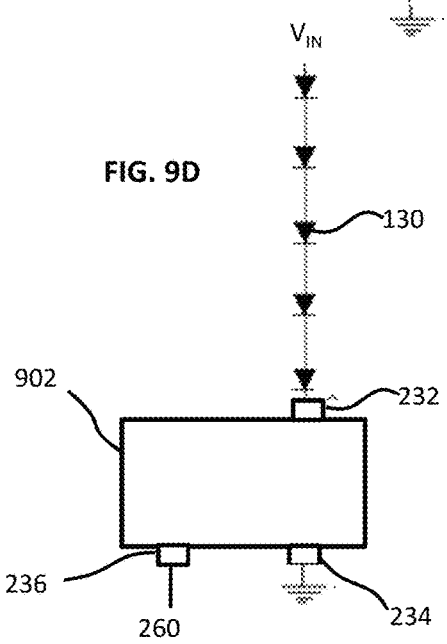

The circuit configuration of FIG. 9D shows LEEs 130 electrically coupled to PCE 902 on the "high side" between connection point 232 and $V_{IN}$, and connection point 234 is electrically coupled to ground. In this embodiment, power for PCE 902 is taken internal to PCE 902, between connection points 232 and 234.

Figure 9E:
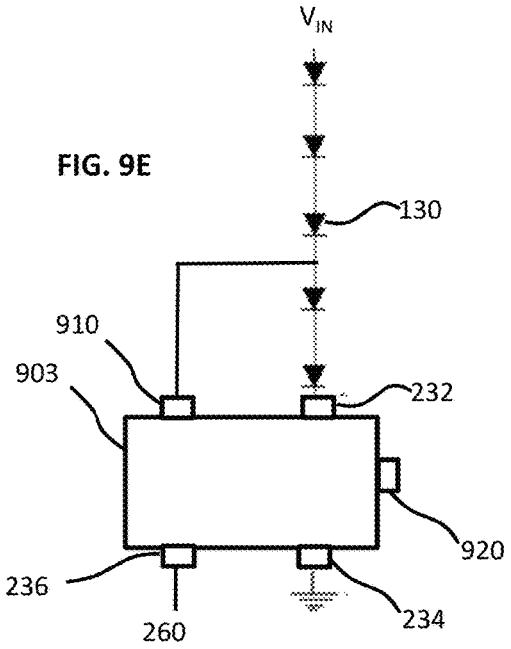

The circuit configuration of FIG. 9E shows LEEs 130 electrically coupled to PCE 903 on the "high side" between connection point 232 and $V_{IN}$. In this embodiment, power for PCE 901 is taken from the LEE string, two LEEs 130 away from connection point 232, and connection point 234 is electrically coupled to ground. In various embodiments, PCE 903 includes a memory set connection point 920 that may be used to store the information provided on communication connection point 260 in the non-volatile memory. In various embodiments, a different or higher level signal or voltage may be required to set the information into memory, for example a higher voltage or current may be required to set a fuse or antifuse or to inject charge into a floating gate, and in various embodiments it may be advantageous to provide a separate connection point (i.e., point 920) for this "set" signal.

Figure 9F:
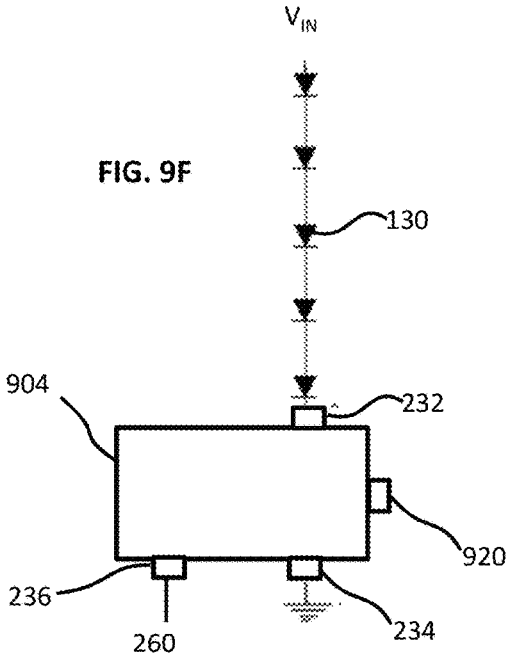

The circuit configuration of FIG. 9F shows LEEs 130 electrically coupled to PCE 904 on the "high side" between connection point 232 and $V_{IN}$. In this embodiment, connection point 234 is electrically coupled to ground, and power for PCE 904 is taken internal to PCE 902, between connection points 232 and 234.

Figure 9G:
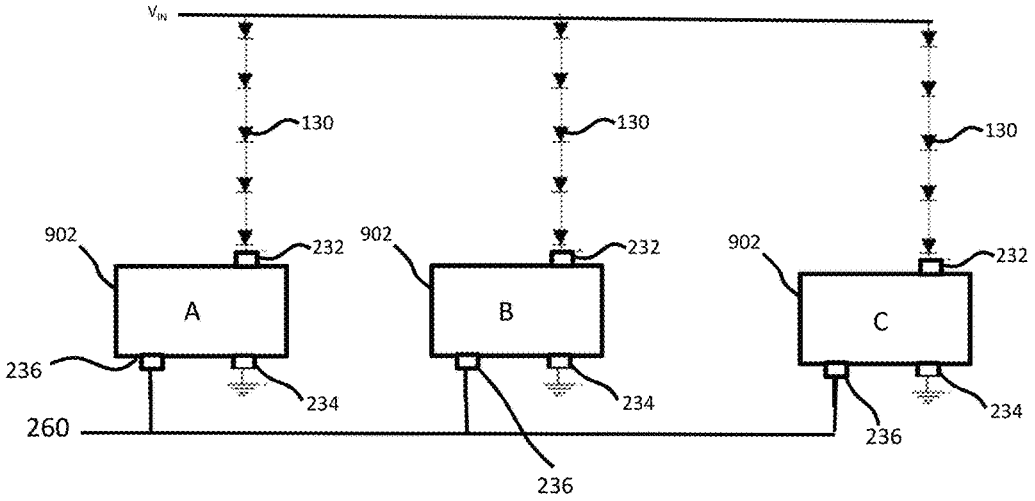

FIG. 9G shows an exemplary configuration of a lighting system in accordance with various embodiments of the present invention that includes three systems of FIG. 9F, that is three PCEs 902 with associated strings of LEEs 130. In various embodiments, all strings may be electrically coupled to a common $V_{IN}$, as shown, and all communication connection points 236 may be electrically coupled to a common communication signal 260, as shown. In various embodiments, each PCE 902 may have a different address, schematically shown in FIG. 9G with identifiers A, B and C, and communication signal(s) may individually address PCEs A, B and C for the purpose of setting the current level and/or dimming the LEEs 130 attached to each separate PCE.

FIGS. 10A-10E schematically depict various configurations of information that may be provided to the PCE to accomplish various functionality. In various embodiments, the information provided to connection point 260 may include a current value and a memory set command as shown in FIG. 10A. The current value is a value representative of the desired current level, and the memory set command sets or commits that value to the non-volatile memory. In various embodiments, the set command may be applied or sent to communication point 260; however, in other embodiments, as described herein, a separate connection point may be utilized for the memory set command.

In various embodiments, the information provided to connection point 260 may include an address, a current value, and a memory set command as shown in FIG. 10B. In various embodiments, the address is representative of one or a group of PCEs, permitting sending and setting the desired current value to one or a group of PCEs.

In various embodiments, the information provided to connection point 260 may include an address and a current value as shown in FIG. 10C. In various embodiments, the address is representative of one or a group of PCEs, permitting sending the desired current value to one or a group of PCEs. In various embodiments, the current value may be sent to one or more PCEs resulting in that current value being implemented in the associated LEEs. In various embodiments, different current values may be sent more than one time to one or more PCEs, for example to evaluate different illumination levels without fixing the current value in non-volatile memory. In various embodiments, a subsequent address, current value, and memory set information, as described in reference to FIG. 10B, may be sent to set a current value to the non-volatile memory.

In various embodiments, the information provided to connection point 260 may include an address and a dimming value, as shown in FIG. 10D. In various embodiments, the current level may have been previously set to the non-volatile memory and information as shown in FIG. 10D may be sent to the PCE to permit dimming of the LEEs associated with that PCE to levels lower than that of the current level in the non-volatile memory.

In various embodiments, the information provided to connection point 260 may include multiple addresses and dimming values, as shown in FIG. 10E. In various embodiments, multiple PCEs with different addresses may be electrically coupled to a common connection point 260, for example as described in reference to FIG. 9G, and signals as shown in FIG. 10E may be used to send different dimming levels to specific PCEs by their address. In various embodiments, the LEEs associated with each PCE may be the same or they may be different, for example having different color, spatial intensity distribution, spectral power distribution, CCT, CRI, or other parameters.

While FIGS. 10A-10E show various information configurations, these are not limitations of the present invention, and in other embodiments other information configurations may be utilized, for example repeated versions of the configurations shown in FIGS. 10-10E, concatenated versions of the configurations shown in FIGS. 10-10E, or any other configurations.

While PCE 200 has been discussed as only receiving information, this is not a limitation of the present invention, and in other embodiments PCE 200 may also transmit information. For example, PCE 200 may transmit information related to the on-time of the connected LEEs, the state of the LEEs (for example, if there is an open-circuit in the LEE string, notification of this condition), temperature of the PCE, or other information. In various embodiments, such information may be transmitted in a fashion associated with the address of the PCE, thus providing localized or spatial information related to each PCE.

As utilized herein, the term "light-emitting element" (LEE) refers to any device that emits electromagnetic radiation within a wavelength regime of interest, for example, visible, infrared or ultraviolet regime, when activated, by applying a potential difference across the device or passing a current through the device. Examples of light-emitting elements include solid-state, organic, polymer, phosphor-coated or high-flux LEDs, laser diodes or other similar devices as would be readily understood. The emitted radiation of an LEE may be visible, such as red, blue or green, or invisible, such as infrared or ultraviolet. An LEE may produce radiation of a continuous or discontinuous spread of wavelengths. An LEE may feature a phosphorescent or fluorescent material, also known as a light-conversion material, for converting a portion of its emissions from one set of wavelengths to another. In some embodiments, the light from an LEE includes or consists essentially of a combination of light directly emitted by the LEE and light emitted by an adjacent or surrounding light-conversion material. An LEE may include multiple LEEs, each emitting essentially the same or different wavelengths. In some embodiments, a LEE is an LED that may feature a reflector over all or a portion of its surface upon which electrical contacts are positioned. The reflector may also be formed over all or a portion of the contacts themselves. In some embodiments, the contacts are themselves reflective. Herein "reflective" is defined as having a reflectivity greater than 65% for a wavelength of light emitted by the LEE on which the contacts are disposed. In some embodiments, an LEE may include or consist essentially of an electronic device or circuit or a passive device or circuit. In some embodiments, an LEE includes or consists essentially of multiple devices, for example an LED and a Zener diode for static-electricity protection. In some embodiments, an LEE may include or consist essentially of a packaged LED, i.e., a bare LED die encased or partially encased in a package. In some embodiments, the packaged LED may also include a light-conversion material. In some embodiments, the light from the LEE may include or consist essentially of light emitted only by the light-conversion material, while in other embodiments the light from the LEE may include or consist essentially of a combination of light emitted from an LED and from the light-conversion material. In some embodiments, the light from the LEE may include or consist essentially of light emitted only by an LED.

One or more non-LEE devices such as Zener diodes, transient voltage suppressors (TVSs), varistors, etc., may be placed on each lighting system to protect the LEEs 130 from damage that may be caused by high-voltage events, such as electrostatic discharge (ESD) or lightning strikes. In one embodiment, conductive trace segments between the LEE strings 208 may be used for placement of a single protection device per lighting system, where the device spans the positive and negative power traces, for example power conductors 110, 120. These trace segments also serve to provide a uniform visual pattern of lines in the web direction, which may be more aesthetically pleasing than a lighting system with noticeable gaps between LEE strings 208. In a more general sense, in addition to conductive traces 160 that are part of string 208, additional conductive traces 206 that may or may not be electrically coupled to other strings 208 and/or power conductors 110, 120 may be formed on substrate 310, for example to provide additional power conduction pathways or to achieve a decorative or aesthetically pleasing look to the pattern on the lighting system or to provide a communication pathway to one or more PCEs 200, for example to provide a control signal to the one or more PCEs 200. These trace segments also serve to provide a uniform visual pattern of lines in the web direction, which may be more aesthetically pleasing than a lighting system with noticeable gaps between LEE strings 208.

In one embodiment, an LEE 130 includes or consists essentially of a bare semiconductor die, which may include a substrate 310 with one or more semiconductor layers disposed thereover. In an exemplary embodiment, LEE 130 represents an LEE such as an LED or a laser, but other embodiments of the invention feature one or more semiconductor dies with different or additional functionality, e.g., processors, sensors, detectors, photovoltaic cells, control elements, and the like. Non-LEE dies may or may not be bonded as described herein, and may or may not have contact geometries differing from those of the LEEs; moreover, they may or may not have semiconductor layers disposed over a substrate as discussed below. In various embodiments the LEE substrate may include or consist essentially of one or more semiconductor materials, e.g., silicon, GaAs, InP, GaN, and may be doped or substantially undoped (e.g., not intentionally doped). In some embodiments, the LEE substrate includes or consists essentially of sapphire or silicon carbide; however, the composition of the substrate is not a limitation of the present invention. In various embodiments the LEE substrate may be substantially transparent to a wavelength of light emitted by the LEE 130 and/or any associated light-conversion material. Each of semiconductor layers may include or consist essentially of one or more semiconductor materials, e.g., silicon, InAs, AlAs, GaAs, InP, AlP, GaP, InSb, GaSb, AlSb, GaN, AlN, InN, and/or mixtures and alloys (e.g., ternary or quaternary, etc. alloys) thereof. In preferred embodiments, LEE 130 is an inorganic, rather than a polymeric or organic, device.

As used herein, wavelength-conversion material or phosphor refers to any material that shifts the wavelengths of light irradiating it and/or that is fluorescent and/or phosphorescent, is utilized interchangeably with the terms "light-conversion material" or "phosphor," and may refer to only a powder or particles or to the powder or particles with a binder. In some embodiments, the phosphor includes or consists essentially of a mixture of one or more wavelength-conversion materials and a matrix material. The wavelength-conversion material is incorporated to shift one or more wavelengths of at least a portion of the light emitted by the light emitter to other desired wavelengths (which are then emitted from the larger device alone or color-mixed with another portion of the original light emitted by the die). A wavelength-conversion material may include or consist essentially of phosphor powders, quantum dots or the like within a transparent matrix. Phosphors are typically available in the form of powders or particles, and in such case may be mixed in binders, e.g., silicone. Phosphors vary in composition, and may include lutetium aluminum garnet (LuAG or GAL), yttrium aluminum garnet (YAG) or other phosphors known in the art. GAL, LuAG, YAG and other materials may be doped with various materials including for example Ce, Eu, etc. The phosphor may be a plurality of individual phosphors. The specific components and/or formulation of the phosphor and/or matrix material are not limitations of the present invention.

The binder may also be referred to as an encapsulant or a matrix material. In one embodiment the binder includes or consists essentially of a transparent material, for example a silicone-based material or epoxy, having an index of refraction greater than 1.35. In one embodiment, the phosphor includes other materials, for example $SiO_2$, $Al_2O_3$, fumed silica or fumed alumina, to achieve other properties, for example to scatter light, to change the viscosity or to reduce settling of the powder in the binder. An example of the binder material includes materials from the ASP series of silicone phenyls manufactured by Shin Etsu, or the Sylgard series manufactured by Dow Corning.

It should be noted that LEEs 130 may have other features than those discussed herein, or may have fewer or more features than those discussed herein; the details of LEEs 130 are not limiting to the present invention.

In various embodiments, an LEE 130 may include or consists essentially of a packaged semiconductor die, for example a packaged laser diode or LED. In various embodiments a packaged LEE may include a semiconductor die, a binder and optionally a wavelength conversion material.

In various embodiments, LEEs 130 may emit light in a relatively small wavelength range, for example having a full width at half maximum in the range of about 20 nm to about 200 nm. In some embodiments, all LEEs 130 may emit light of the same or substantially the same wavelength, while in other embodiments different LEEs 130 may emit light of different wavelengths. In some embodiments LEEs 130 may emit white light, for example that is perceived as white light by the eye. In some embodiments, the white light may be visible light with a spectral power distribution the chromaticity of which is close to the blackbody locus in the CIE 1931 xy or similar color space. In some embodiments, white light has a color temperature in the range of about 2000 K to about 10,000 K. The emission wavelength, full width at half maximum (FWHM) of the emitted light or radiation or other optical characteristics of LEEs 130 may not be all the same and are not a limitation of the present invention.

In general in the above discussion the arrays of semiconductor dies, light emitting elements, optics, and the like have been shown as square or rectangular arrays; however this is not a limitation of the present invention and in other embodiments these elements may be formed in other types of arrays, for example hexagonal, triangular or any arbitrary array. In some embodiments these elements may be grouped into different types of arrays on a single substrate.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A programmable current control device for an illumination system, the device comprising:

a first connection point for receiving information representative of a desired output current level;

a memory element for storing the information representative of the desired output current level received at the first connection point, wherein the memory element is nonvolatile, whereby the memory element retains the information without application of power to the memory element;

a second connection point and a third connection point for electronically connecting to at least a portion of the illumination device; and a control circuit configured to maintain an applied current that is ±10% of the desired output current level, between the second and third connection points, by (i) receiving a reference voltage representative of the desired output current level from the memory element, (ii) applying the applied current to the at least a portion of the illumination device via the second and third connection points, (iii) receiving a resulting feedback voltage from the at least a portion of the illumination device, (iv) adjusting the applied current to reduce a difference between the feedback voltage and the reference voltage, and (v) repeating steps (ii)-(iv), wherein the control circuit comprises an operational amplifier, a first transistor, and a second transistor, wherein:

the operational amplifier has (i) a first input configured to receive the reference voltage, (ii) a second input configured to receive the feedback voltage, (iii) an output configured to output a signal representative of the difference between the feedback voltage and the reference voltage to a base of the first transistor, (iv) a first terminal for receiving input power, and (v) a second terminal electrically coupled to ground, the first transistor is coupled to the output of the operational amplifier, and a collector of the first transistor drives a base of the second transistor, and the first and second transistors are configured to receive the signal from the output of the operational amplifier and adjust the applied current to reduce the difference between the feedback voltage and the reference voltage.

2. The device of claim 1, wherein the memory element is one-time programmable.

3. The device of claim 1, wherein the memory element is reprogrammable.

4. The device of claim 1, wherein the memory element comprises at least one of a fusible link, an antifuse, an EPROM, an EEPROM, NOR Flash, NAND flash, nvSRAM, FeRAM, MRAM, or PCM.

5. The device of claim 1, wherein the first connection point is configured to receive signals to store the information representative of the desired output current level in the memory element.

6. The device of claim 1, wherein (i) the programmable current control device is configured with an identifier, (ii) the first connection point is configured to receive identifier information, and (iii) the control circuit is configured to store, within the memory element, the information representative of the desired output current level received at the first connection point only if the control circuit determines that the identifier information received at the first connection point matches the identifier of the programmable current control device.

7. The device of claim 6, wherein the illumination system comprises one or more additional programmable current control devices each configured with an identifier, and the identifier of the programmable current control device is different from the identifiers of the additional programmable current control devices.

8. The device of claim 6, further comprising a communication element for receiving the information representative of the desired output current level from the first connection point and supplying the information representative of the desired output current level to the memory element, wherein the communication element utilizes a one-wire communication protocol to receive identifier information and information representative of the desired output current at the first connection point.

9. The device of claim 1, further comprising a communication element for receiving the information representative of the desired output current level from the first connection point and supplying the information representative of the desired output current level to the memory element.

10. The device of claim 9, wherein the communication element supports at least one of serial protocol, parallel protocol, or up/down protocol.

11. The device of claim 9, wherein the communication element utilizes a one-wire communication protocol to receive information representative of the desired output current level at the first connection point.

12. The device of claim 1, wherein the memory element comprises a potentiometer.

13. The device of claim 1, further comprising a modulation element configured to receive a modulation signal and modify the applied current in response to the modulation signal.

14. The device of claim 1, wherein the first connection point is configured to receive information representative of a dimming level, and the control circuitry circuit is configured to adjust the applied current to a value represented by the dimming level.

15. The device of claim 1, wherein (i) the programmable current control device is configured with an identifier, (ii) the first connection point is configured to receive information representative of a dimming level, (iii) the first connection point is configured to receive identifier information, and (iv) the control circuit is configured to adjust the applied current to a value represented by the dimming level if the control circuit determines that the identifier information received at the first connection point matches the identifier of the programmable current control device.

16. An illumination system comprising:

first and second power conductors;

a plurality of light-emitting strings, each light-emitting string having a first end electrically coupled to the first power conductor and a second end electrically coupled to the second power conductor, wherein the power conductors supply power to the light-emitting strings; and one or more programmable current control devices each configured to supply a desired output current level to one or more of the light-emitting strings, wherein each programmable current control device comprises:

a first connection point for receiving information representative of the desired output current level, a memory element for storing the information representative of the desired output current level received at the first connection point, wherein the memory element is nonvolatile, whereby the memory element retains the information without application of power to the memory element, a second connection point and a third connection point electronically coupled to the one or more light-emitting strings, and a control circuit configured to maintain an applied current that is ±10% of the desired output current level, between the second and third connection points, by (i) receiving a reference voltage representative of the desired output current level from the memory element, (ii) applying the applied current to the at least a portion of the illumination device via the second and third connection points, (iii) receiving a resulting feedback voltage from the at least a portion of the illumination device, (iv) adjusting the applied current to reduce a difference between the feedback voltage and the reference voltage, and (v) repeating steps (ii)-(iv), wherein the control circuit comprises an operational amplifier, a first transistor, and a second transistor, and wherein:

the operational amplifier has (i) a first input configured to receive the reference voltage, (ii) a second input configured to receive the feedback voltage, (iii) an output configured to output a signal representative of the difference between the feedback voltage and the reference voltage to a base of the first transistor, (iv) a first terminal for receiving input power, and (v) a second terminal electrically coupled to ground, the first transistor is coupled to the output of the operational amplifier, and a collector of the first transistor drives a base of the second transistor, and the first and second transistors are configured to receive the signal from the output of the operational amplifier and adjust the applied current to reduce the difference between the feedback voltage and the reference voltage.

17. The illumination system of claim 16, wherein the one or more programmable current control devices comprises a plurality of programmable current control devices.

18. The illumination system of claim 17, wherein each programmable current control device is coupled to a different light-emitting string.

19. The illumination system of claim 17, wherein each light-emitting string is coupled to a different programmable current control device.

20. The illumination system of claim 17, wherein the first connection points of all of the programmable current control devices are electrically coupled together.

21. The illumination system of claim 16, wherein the memory element is one-time programmable.

22. The illumination system of claim 16, wherein the memory element is reprogrammable.

23. The illumination system of claim 16, wherein (i) each programmable current control device is configured with an identifier, (ii) the first connection point is configured to receive identifier information, and (iii) the control circuit is configured to store, within the memory element, the information representative of the desired output current level received at the first connection point only if the control circuit determines that the identifier information received at the first connection point matches the identifier of the programmable current control device.

24. The illumination system of claim 23, each programmable current control device comprises a communication element for receiving the information representative of the desired output current level from the first connection point and supplying the information representative of the desired output current level to the memory element, wherein the communication element utilizes a one-wire communication protocol to receive identifier information and information representative of the desired output current at the first connection point.

25. The illumination system of claim 16, wherein the first connection point is configured to receive information representative of a dimming level, and the control circuit is configured to adjust the applied current to a value represented by the dimming level.

26. The illumination system of claim 16, wherein (i) each programmable current control device is configured with an identifier, (ii) the first connection point is configured to receive information representative of a dimming level, (iii) the first connection point is configured to receive identifier information, and (iv) the control circuit is configured to adjust the applied current to a value represented by the dimming level if the control circuit determines that the identifier information received at the first connection point matches the identifier of the programmable current control device.

* * * * *